US006805175B1

(12) United States Patent
Pinkas et al.

(10) Patent No.: US 6,805,175 B1
(45) Date of Patent: Oct. 19, 2004

(54) POWDER TRANSFER METHOD AND APPARATUS

(75) Inventors: Daniel M. Pinkas, Alameda, CA (US); Claus G. Lugmair, San Jose, CA (US)

(73) Assignee: Symyx Technologies, Inc., Santa Clara, CA (US)

( * ) Notice: Subject to any disclaimer, the term of this patent is extended or adjusted under 35 U.S.C. 154(b) by 0 days.

(21) Appl. No.: 10/460,521

(22) Filed: Jun. 12, 2003

(51) Int. Cl.[7] ..... B65B 1/04

(52) U.S. Cl. ..... 141/130; 141/67; 422/100; 406/16; 406/28

(58) Field of Search ..... 141/1, 4, 5, 6, 141/7, 59, 67, 130, 71, 81, 129, 83; 422/99, 100; 406/16, 17, 28, 29, 30

(56) References Cited

U.S. PATENT DOCUMENTS

| | | | | |
|---|---|---|---|---|
| 2,540,059 A | | 1/1951 | Stirn et al. | |
| 2,907,357 A | | 10/1959 | Sandhage et al. | |
| 3,339,595 A | | 9/1967 | Pechmann | |
| 3,656,517 A | * | 4/1972 | Taylor et al. | 141/1 |
| 3,719,214 A | | 3/1973 | Erndt | |
| 3,847,191 A | | 11/1974 | Aronson | |
| 3,884,741 A | | 5/1975 | Sexstone | |
| 4,158,035 A | | 6/1979 | Haase et al. | |
| 4,509,568 A | | 4/1985 | Kawaguchi et al. | |
| 4,721,233 A | | 1/1988 | Asada | |
| 4,949,766 A | | 8/1990 | Coatsworth | |
| 4,974,646 A | | 12/1990 | Martin et al. | |
| 5,002,103 A | | 3/1991 | Marescalchi | |
| 5,055,408 A | | 10/1991 | Higo et al. | |
| 5,339,871 A | * | 8/1994 | Collins et al. | 141/1 |
| 5,959,297 A | | 9/1999 | Weinberg et al. | |
| 5,985,356 A | | 11/1999 | Schultz et al. | |
| 6,004,617 A | | 12/1999 | Schultz et al. | |
| 6,030,917 A | | 2/2000 | Weinberg et al. | |
| 6,063,633 A | | 5/2000 | Willson, III | |
| 6,065,508 A | | 5/2000 | Ball et al. | |
| 6,087,181 A | | 7/2000 | Cong | |
| 6,149,882 A | | 11/2000 | Guan et al. | |
| 6,175,409 B1 | | 1/2001 | Nielsen et al. | |
| 6,684,917 B2 | * | 2/2004 | Zhu et al. | 141/18 |

FOREIGN PATENT DOCUMENTS

| | | |
|---|---|---|
| WO | WO 00/09255 | 2/2000 |
| WO | WO 00/14529 | 3/2000 |
| WO | WO 00/17413 | 3/2000 |
| WO | WO 00/51720 | 9/2000 |

OTHER PUBLICATIONS

Argonaut Technologies, *Argonaut—Products—Lead Discovery—Redi*, http://www.argotech.com/products/lead_discovery/redi.html, Aug. 27, 2002, 1 page.

(List continued on next page.)

*Primary Examiner*—Steven O. Douglas
(74) *Attorney, Agent, or Firm*—Senniger Powers

(57) ABSTRACT

Apparatus for aspirating and dispensing powder, comprising a hopper having a powder transfer port and a suction port for connection to a source of suction to establish an upward flow of air (or other gas) through the transfer port. A gas flow control system varies the upward flow through the transfer port to have different velocities greater than 0.0 m/s. These velocities include an aspirating velocity for aspirating powder into the hopper through the transfer port to form a fluidized bed of powder in the hopper, and a dispensing velocity less than the aspirating velocity but sufficient to maintain fluidization of the bed while allowing powder from the bed to gravitate through the transfer port for dispensing into one or more destination receptacles. A method of aspirating and dispensing powder is also disclosed.

99 Claims, 16 Drawing Sheets

OTHER PUBLICATIONS

Argonaut Technologies, *Argonaut—Products—Lead Discovery—Redi Specifications*, http://www.argotech.com/products/lead_discovery/redi_specs.html, Aug. 27, 2002, 2 pages.

Argonaut Technologies, *Argonaut—Products—Lead Discovery—Redi Configuration Options*, http://www.argotech.com/products/lead_discovery/redi_config.html, Aug. 27, 2002, 2 pages.

Argonaut Technologies, *Argonaut—Products—Lead Discovery—Calli and Moss*, http://www.argotech.com/products/lead_discovery.html, Aug. 27, 2002, 1 page (second page missing).

Argonaut Technologies, *Argonaut—Products—Lead Discovery—Calli and Moss Specifications*, http://www.argotech.com/products/lead_discovery/calli_specs.html, Aug. 27, 2002, 2 pages.

Bryant, et al., *Advances in Powder–Dosing Technology*, Innovations In Pharmaceutical Technology, Jun., 2002, 7 pages.

Chemspeed, *Chemspeed Laboratory Instruments and Services for Scientists*, http://www.chemspeed.com/accelratordds.html, Aug. 27, 2002, 2 pages.

Meridica, *Microcrystalline Cellulose fill weights on the Xcelodose™ system*, Jan. 14, 2002, 9 pages.

Meridica, *Evaluation of a Solid Dose Delivery Technology for Filling Capsules and Other Small Containment Systems with a Broad Range of Drug Substance and Carriers*, Apr. 2002, 5 pages.

Mettler Toledo, *Flexiweigh Automated Powder Dispensing*, undated, 2 pages.

Schering–Plough Research Institute, Adaptive Powder Dispensing System, date at least as early as Mar. 3, 2003, 1 page.

Publication No. 2002/0014546 A1, United States Patent and Trademark Office, Feb. 7, 2002, 28 pages, United States.

Publication No. US 2002/0042140 A1, United States Patent and Trademark Office, Apr. 11, 2002, 45 pages, United States.

Publication No. US 2002/0045265 A1, United States Patent and Trademark Office, Apr. 18, 2002, 81 pages, United States.

Publication No. US 2002/0048536 A1, United States Patent and Trademark Office, Apr. 25, 2002, 90 pages, United States.

Publication No. US 2002/0170976 A1, United States Patent and Trademark Office, Nov. 21, 2002, 16 pages, United States.

* cited by examiner

POWDER TRANSFER METHOD AND APPARATUS

BACKGROUND OF THE INVENTION

This invention relates generally to powder handling apparatus and methods, and more particularly to an automated system for quickly transferring quantities of powder material from one or more sources to one or more destination receptacles.

Automated powder dispensing systems are used in many laboratory and commercial applications. In the pharmaceutical industry, for example, such systems are used to fill capsules with small but accurate doses of drugs, typically using gravimetric or volumetric techniques. These systems suffer various disadvantages, including an inability to handle a wide range of particulate materials at optimal speeds and accuracies, particularly when very small doses are involved (e.g., 20 mg or less). Further, the operation of conventional systems tends to crush the particles being handled.

Automated powder handling systems also have application to combinatorial (high-throughput) research, such as combinatorial catalysis research where catalyst candidates are evaluated using various screening techniques known in the art. See, for example, U.S. Pat. No. 5,985,356 to Schultz et al., U.S. Pat. No. 6,004,617 to Schultz et al., U.S. Pat. No. 6,030,917 to Weinberg et al., U.S. Pat. No. 5,959,297 to Weinberg et al., U.S. Pat. No. 6,149,882 to Guan et al., U.S. Pat. No. 6,087,181 to Cong, U.S. Pat. No. 6,063,633 to Willson, U.S. Pat. No. 6,175,409 to Nielsen et al., and PCT patent applications WO 00/09255, WO 00/17413, WO 00/51720, WO 00/14529, each of which U.S. patents and each of which PCT patent applications, together with its corresponding U.S. application(s), is hereby incorporated by reference in its entirety for all purposes.

The efficiency of a catalyst discovery program is, in general, limited by rate-limiting steps of the overall process work flow. One such rate-limiting step has been the mechanical pretreatment and handling of catalyst candidates after synthesis but before screening. U.S. application Ser. No. 902,552, filed Jul. 9, 2001 by Lugmair, et al., published Feb. 7, 2002 as Pub. No. U.S. 2002/0014546 A1, and assigned to Symyx Technologies, Inc., incorporated herein by reference in its entirety for all purposes, is directed to more efficient protocols and systems for effecting the mechanical treatment of materials, and especially, mechanical treatment of catalysis materials such as heterogeneous catalysts and related materials. The disclosed protocols provide an efficient way to prepare catalysis materials having a controlled particle size for optimal screening. However, the handling and transfer of such powders from one location to another as they are prepared for screening and ultimately delivered to the screening device (e.g., a parallel flow reactor) is not addressed in detail.

SUMMARY OF THE INVENTION

It is, therefore, an object of this invention to provide for more efficient protocols and apparatus for the handling of powder in an automated manner without subjecting the particles to crushing forces or other conditions which might change the mechanical or chemical characteristics of the particles (e.g., particle size distribution).

In general, the apparatus of this invention is for aspirating and dispensing powder. The apparatus comprises a hopper having one or more powder transfer ports and one or more suction ports adapted for connection to one or more sources of suction to establish an upward flow of air or other gas through the one or more transfer ports. The apparatus also includes a gas flow control system for varying the upward flow through the one or more transfer ports to have different velocities greater than 0.0 m/s. One such velocity is an aspirating velocity for aspirating powder into the hopper through at least one of the one or more transfer ports to form a fluidized bed of powder in the hopper above the at least one transfer port. Another velocity is a dispensing velocity less than the aspirating velocity but sufficient to maintain fluidization of the bed while allowing powder from the bed to gravitate through at least one of said one or more transfer ports for dispensing into one or more destination receptacles.

The present invention is also directed to a method of transferring powder from one or more sources to one or more destination receptacles. The method comprises the steps of establishing an upward flow of air or other gas through one or more transfer ports of a hopper, and maintaining the upward flow at an aspirating velocity sufficient to aspirate powder into the hopper from at least one of the one or more sources through at least one of the one or more transfer ports to form a fluidized bed of powder in the hopper above the at least one transfer port. The method also includes the step of reducing the velocity of the upward flow of air or other gas to a dispensing velocity less than said aspirating velocity to dispense powder from the hopper by allowing powder from the fluidized bed to gravitate through at least one of the one or more transfer ports into at least one of the one or more destination receptacles.

In another aspect, the method comprises the steps of establishing an upward flow of air or other gas through one or more transfer ports of a hopper, and varying the upward flow through the transfer port to have different velocities greater than 0.0 m/s. These velocities include an aspirating velocity for aspirating powder into the hopper from at least one of the one or more sources through at least one of the one or more transfer ports to form a fluidized bed of powder in the hopper above the at least one transfer port, and a dispensing velocity less than the aspirating velocity but sufficient to maintain fluidization of the bed while allowing powder from the bed to gravitate through at least one of the one or more transfer ports for dispensing into at least one of the one or more destination receptacles.

Other objects and features will be in part apparent and in part pointed out hereinafter.

BRIEF DESCRIPTION OF THE DRAWINGS

Corresponding parts are designated by corresponding reference numbers throughout the drawings.

DETAILED DESCRIPTION OF PREFERRED EMBODIMENTS

Figure 1:
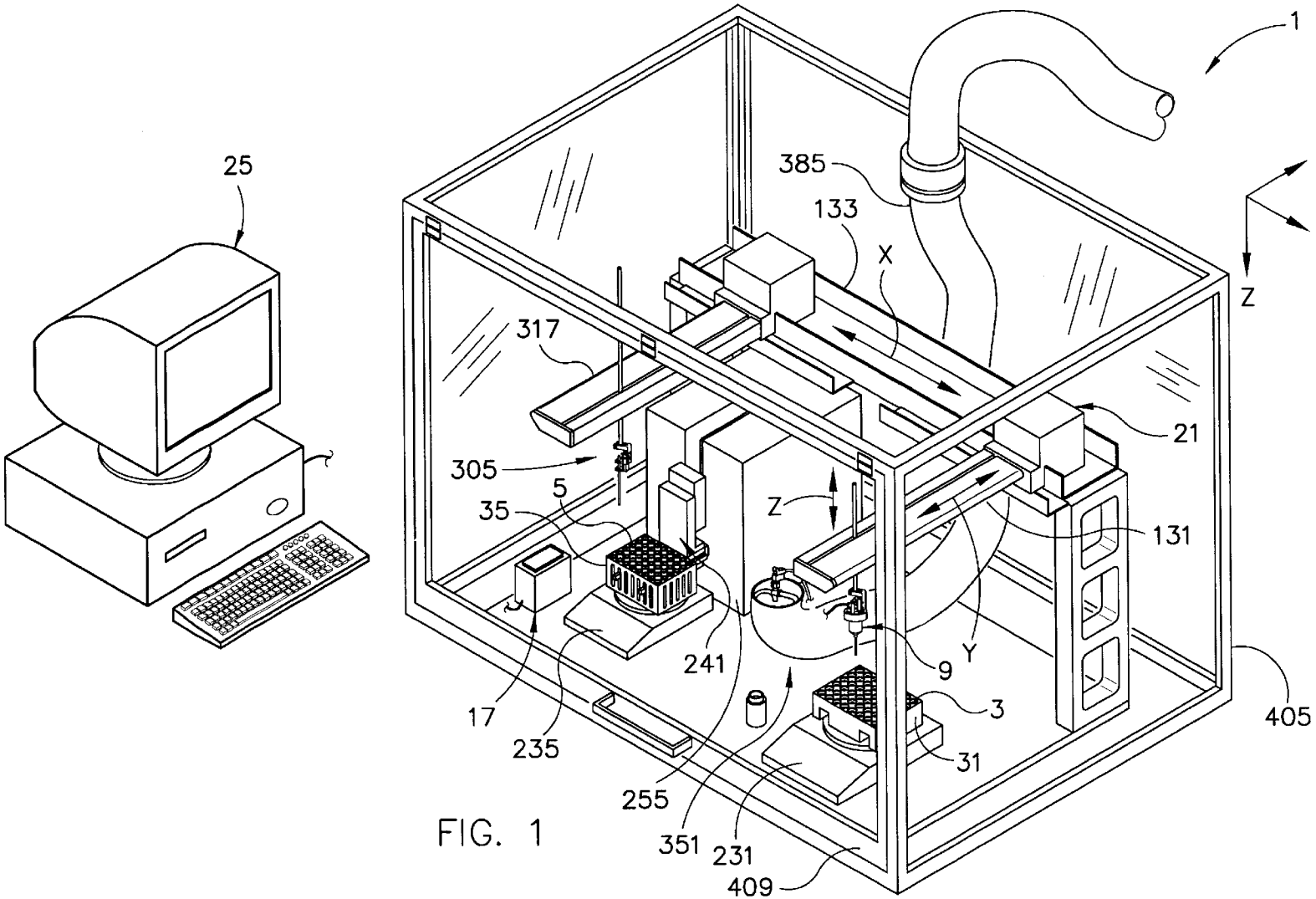
FIG. 1 is a perspective of one embodiment of powder transfer apparatus of the present invention.
Figure 2:
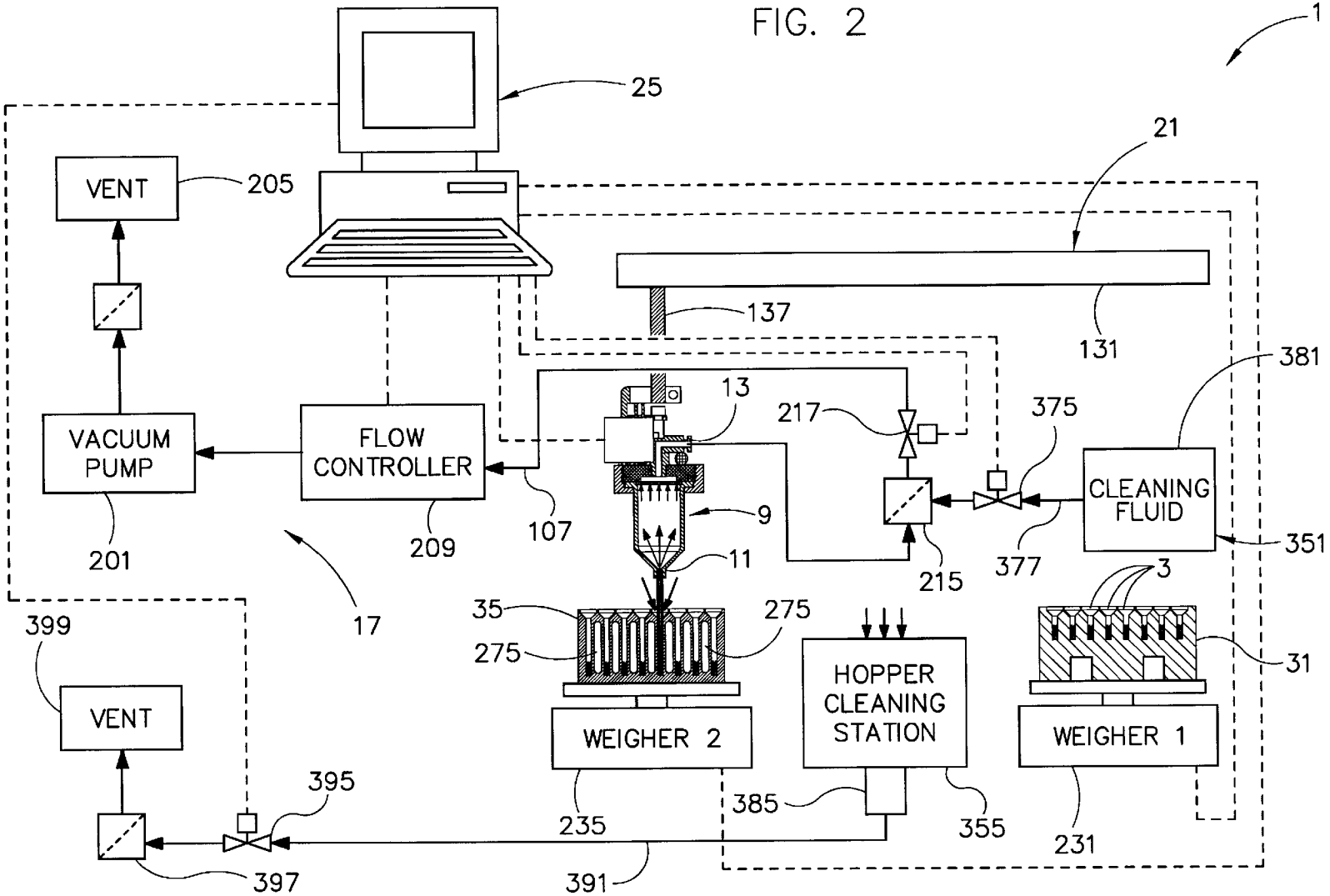
FIG. 2 is a diagrammatic view showing various components of the apparatus.

Referring to FIGS. 1 and 2, one embodiment of a powder transfer system of the present invention is designated in its entirety by the reference numeral 1. In general, the system is adapted for transferring powder (e.g., catalysis materials) from one or more sources 3 to one or more destination receptacles 5. As used herein, the term "powder" includes particles having a particle size distribution with a mean particle size ranging from about 10 nm to about 1 mm, and especially from about 10 um to about 500 um.

The components of the system 1 include a hopper, generally indicated at 9, having a powder transfer port 11 and a suction port 13, and a gas flow control system, generally designated 17, which connects to the suction port of the hopper to establish an upward flow of air or other gas through the transfer port. A transport system, generally designated 21, is provided for transporting the hopper 9 between the one or more sources 3 and the one or more destination receptacles 5. As will be described in detail hereinafter, the gas flow control system 17 is operable to vary the upward flow of gas (e.g., air) through the transfer port 11 to have different velocities, namely, aspirating, transporting and dispensing velocities. The automated system operates under the control of a processor, generally designated 25 in FIGS. 1 and 2. This processor may be a programmable microprocessor or other suitable processing device.

In the particular embodiment of FIG. 1, the one or more sources 3 comprise an array of source wells (e.g., an array of 96 such wells) in a monolithic block 31 or other holder, and the one or more destination receptacles 5 comprise an array of destination wells (e.g., an array of 96 such wells) formed in a monolithic block 35 or other holder. The size and shape of the source and destination wells 3, 5 can vary. In one embodiment, the source wells 3 have an inside diameter of about 6 mm and a height of about 40 mm, and the destination wells 5 have an inside diameter of about 4 mm and a depth of about 40 mm. Further, vessels or receptacles of any type could be used in lieu of the wells 3, 5 shown in FIG. 1. Similarly, the number and arrangement of such vessels and receptacles forming the arrays can vary. As will be described, the system of this invention is able to accommodate different modes of transfer, including transfers involving one source to one destination receptacle (one-to-one), one source to multiple destination receptacles (one-to-many), or multiple sources to multiple destination receptacles (many-to-many).

Figure 3:
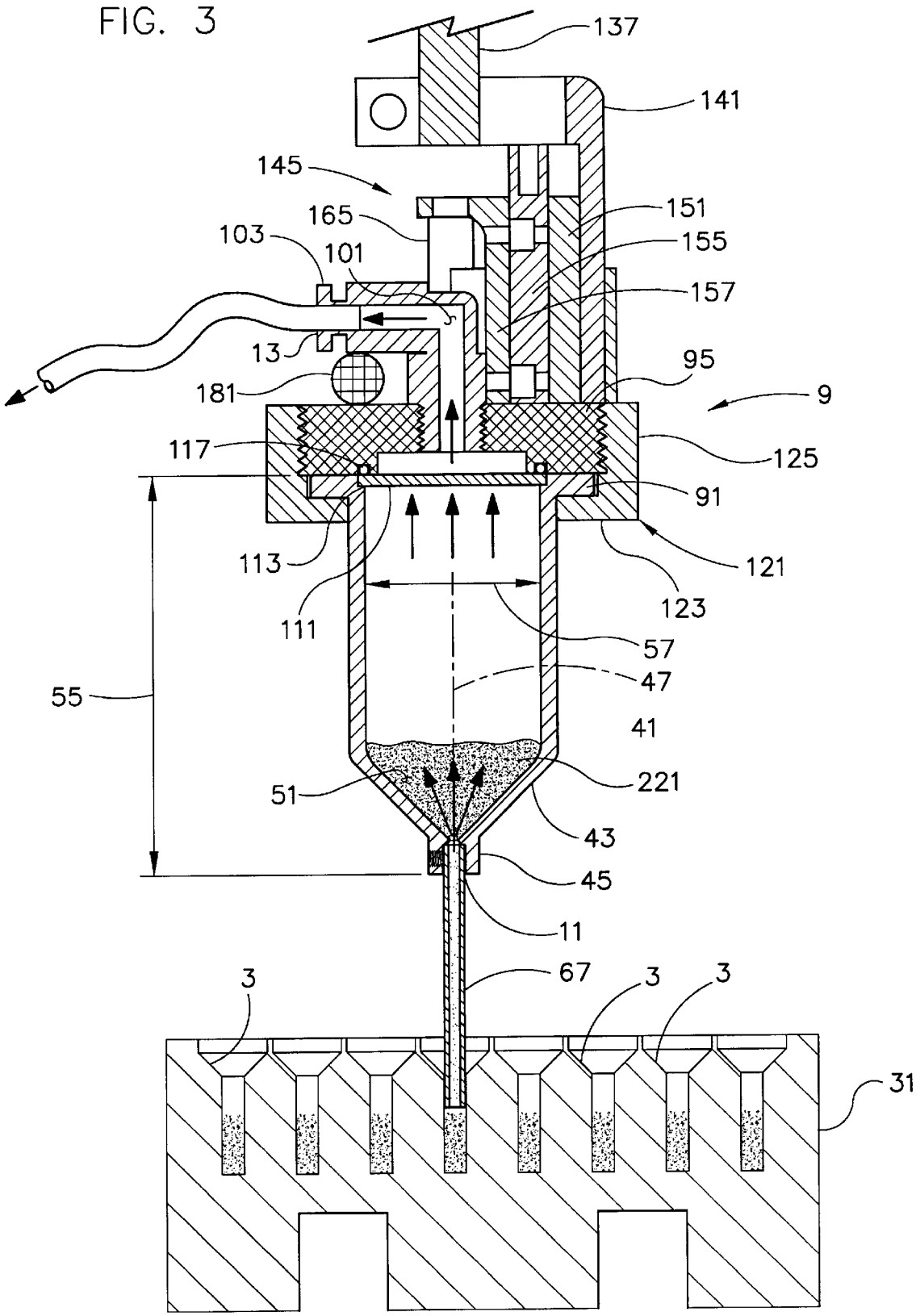
FIG. 3 is a sectional view showing a hopper assembly.

FIG. 3 shows one embodiment of the hopper 9. In this embodiment, the hopper has a cylindric upper section 41 and a funnel-shaped lower section 43 which terminates in a generally cylindric extension 45 on the central vertical axis 47 of the hopper. The lower section 43 has an interior surface 51 which slopes down to the transfer port 11, the slope preferably being in the range of about 30 to 85 degrees, more preferably in the range of about 35 to 70 degrees, still more preferably in the range of about 40 to 60 degrees, and most preferably about 45 degrees. The hopper 9 is made of a suitable polymeric material (e.g., polycarbonate), metal, or ceramic and the interior surface of the hopper is preferably smooth to facilitate flow of powder from the hopper. In the case of a polymer material, the interior surface of the hopper may be smoothed by applying an appropriate solvent finish, and in the case of a metal, the surface may be polished. The size of the hopper 9 will vary, depending on need and application. In one embodiment, for example, the hopper has an overall height 55 in the range of about 0.25 in to 24.0 in., more preferably about 0.4 in to 12.0 in., even more preferably about 0.8 in. to 6.0 in, and still more preferably about 1.0 to 3.0 in; an inside diameter 57 in the range of about 0.25 in to 12.0 in., more preferably about 0.2 in to 6.0 in., even more preferably about 0.4 in. to 3.0 in, and still more preferably about 0.8 to 1.5 in; and a total volumetric capacity (as defined by the sloped and cylindric interior surface of the hopper) in the range of about 1 ml to 40 l, more preferably about 10 ml to 2.0 l, even more preferably about 25 to 500 ml , and still more preferably about 50 ml. These ranges can vary.

Figure 4:
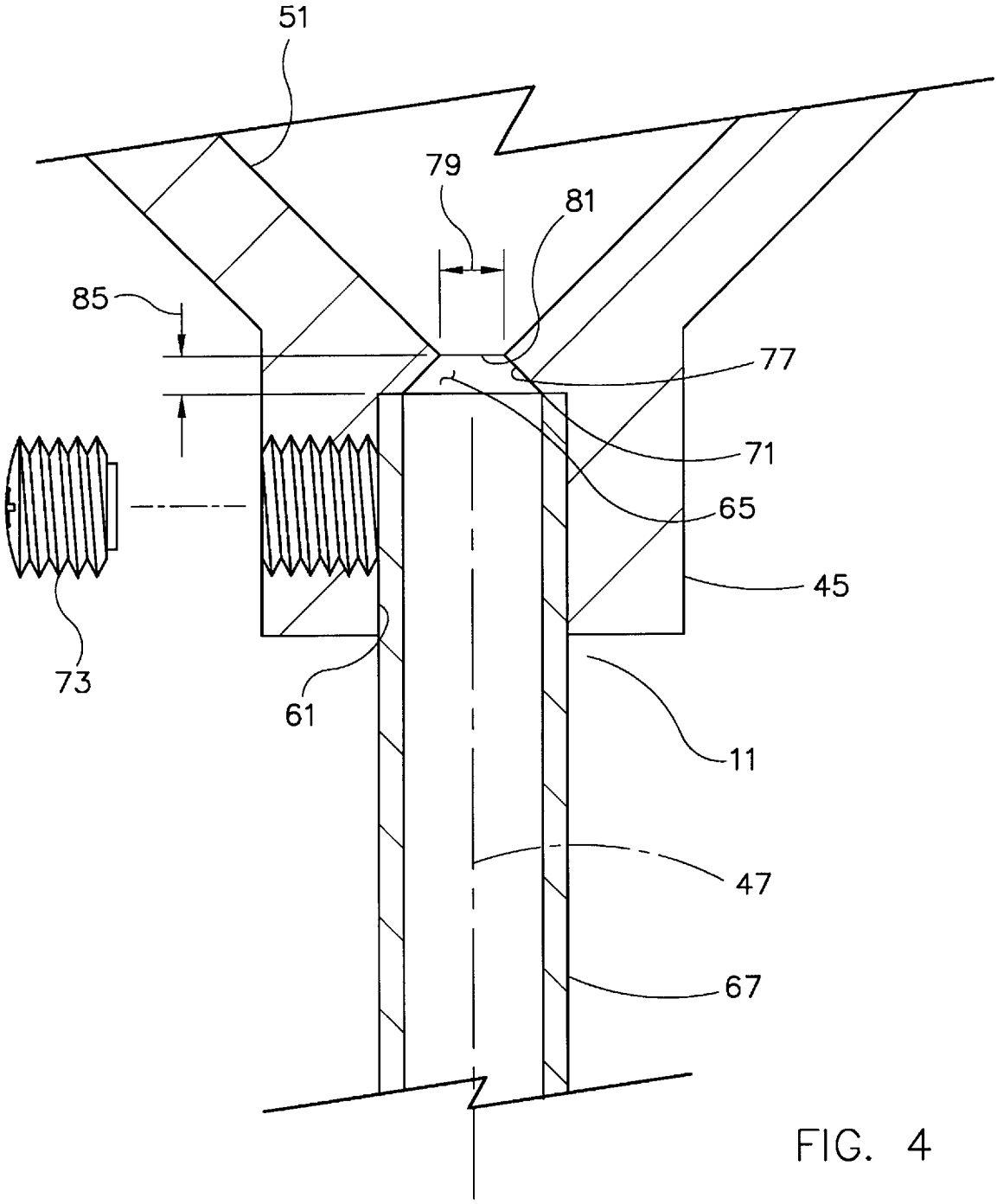
FIG. 4 is an enlarged sectional view showing the orifice of a transport port of the hopper assembly.

Referring to FIG. 4, the transfer port 11 at the lower end of the hopper 9 comprises a passage 61 through the vertical extension 45 having an upper end configured as an orifice 65. The transfer port 11 also includes a conduit in the form of a transfer tube 67 extending down from the passage 61. In the embodiment shown in FIG. 4, the upper end of the tube 67 preferably abuts an internal annular shoulder 71 in the passage 61 directly below the orifice 65 and is held in place by suitable means, such as by a set screw 73 and/or friction (press) fit inside the passage 61. Preferably, the inside diameter of the transfer tube 67 is substantially equal to or greater than the maximum diameter of the orifice 65 at the shoulders 71 so that the orifice provides the greatest restriction to air flow through the transfer port 11 and so that no powder accumulates on the lip of the transfer tube.

In the preferred embodiment (FIG. 4), the orifice 65 has a generally conical wall 77 tapering upwardly from the internal shoulder 71 in the passage 61 to a minimum diameter 79 at a planar knife edge 81 which defines the intersection of the tapered orifice wall 77 and the sloped interior surface 51 of the hopper 9. This edge 81 is preferably circular, although other shapes are possible, and defines, in effect, a two-dimensional "gate" through which gas and powder particles flow to and from the hopper 9. In general, if gas flowing up through this gate 81 has a velocity greater than the free-fall terminal velocity of a powder particle, the particle will be aspirated into the hopper and, once in, will stay in the hopper. If the gas velocity falls below the terminal velocity of the particle, the particle will fall through the gate 81 and out of the hopper 9. It is preferable that the "gate" of the orifice 6S has a short axial dimension (i.e., be substantially planar) to provide a clear boundary determining the direction of particle movement in the direction of the gas flow.

The axial location of the orifice 65 in the passage can vary. The shape and dimensions of the orifice may also vary, so long as it has the functional characteristics described above. In general, the orifice has a diameter at the "gate" in the range of 0.1 mm to 10 mm, more preferably in the range of 0.5 mm to 6 mm, more preferably in the range of 0.75 mm to 4 mm, and even more preferably in the range of 1.0 mm to 3.0 mm. The optimal size for any given application will depend on various factors, including the particle size distribution of powders being handled. More specifically, the ratio of the orifice diameter 79 to particle size is preferably in the range of about 100:1 to 5:1, more preferably in the range of about 50:1 to 5:1, and even more preferably in the range of about 30:1 to 10:1. By way of example only, for SiC particles having a size of 150 microns, the orifice may have a gate diameter 79 of about 1.5 mm, an axial length 85 of about 1.0 mm to 2.0 mm, and the included angle of the conical wall may be about 90 degrees.

The transfer tube 67 is of a chemically inert material, and in one embodiment is fabricated from conventional thin-wall hypodermic metal tubing, e.g., size #12 tubing having an inside diameter of about 3.0 mm to 4.0 mm and an inside diameter approximately equal to or less than the diameter of the orifice 65 at the shoulder 71. The outside diameter of transfer tube 67 should be such as to avoid any contact with the walls of the source wells 3 and destination wells 5. By way of example, the outside diameter of the transfer tube 67 may be 3 mm if the source wells 3 have an inside diameter of 6 mm and the destination wells 5 have an inside diameter of 4 mm. The length of the transfer tube 67 will depend on the depth of the source wells 3 and destination wells 5. By way of example, the tube may have a length in the range of about 0.5 to 6.0 in or more, more preferably in the range of about 1.0 to 3.0 in., and most preferably in the range of about 1.0 in. to 2.0 in.

The upper section 41 of the hopper 9 is formed with a radial flange 91 (FIG. 3), which supports a cover or lid 95 for the hopper. The suction port 13 comprises, in one embodiment a flow passage 101 in a fitting 103 having one end threaded in an opening in the cover 95 and its opposite end connected to a suction line 107. Preferably, the fitting 103 is a quick-connect, quick-disconnect fitting for quick attachment and detachment of the suction line 107 to the fitting. A filter 111 received in an annular recess 113 between the upper end of the hopper 9 and the cover 95 blocks entry of powder into the suction line 107. The filter also preferably functions to flatten the velocity profile of the gas flowing through the hopper, so that the velocity at the center of the hopper is not substantially greater than the velocity adjacent the side wall of the hopper. An 0-ring 117 seals the interfit between the hopper 9, cover 95 and filter 111. The cover 95 is secured to the hopper by an annular retaining cap 121 having a lower flange 123 underlying the radial flange 91 on the hopper, and a side wall 125 which threadably engages the cover 95. To tighten the assembly, the retaining cap 121 is positioned as shown in FIG. 3, and the cover 95 is threaded down into the cap tight against the radial flange 91 of the hopper 9 to squeeze the O-ring 117 and seal the joint with the filter 111 in place.

In the particular embodiment of FIG. 3, the hopper 9 has only one transfer port 11 and one suction port 13. However, it will be understood that more than one transfer port may be provided. Similarly, more than one suction port may be provided, each connected to a separate vacuum source or to a common source.

Figure 5:
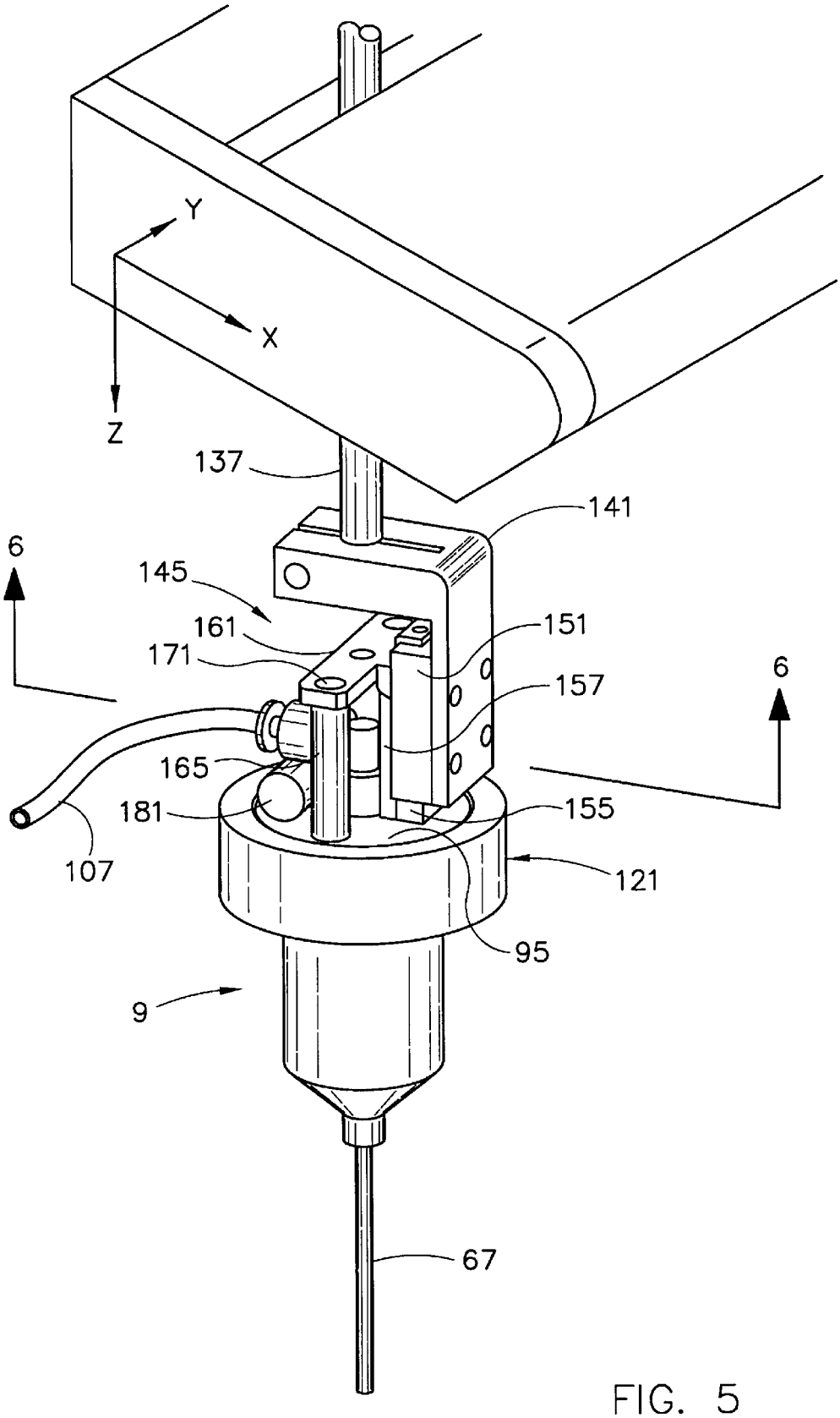
FIG. 5 is a perspective of the hopper assembly as carried by a robot, only a portion of which is shown.

The transport device 21 comprises a robot (e.g., a Cavro robot) having an arm 131 mounted on a rail 133 for movement along a horizontal X-axis, and a vertical rod 137 mounted on the arm for horizontal movement with respect to the arm along a Y-axis and for vertical movement with respect to the arm 131 along a Z axis corresponding to the longitudinal axis of the rod (FIGS. 1 and 3). In the embodiment of FIG. 3, the Z-axis corresponds to the central vertical axis 47 of the hopper 9, but these two axes could be offset. The hopper 9 is mounted on the lower end of the rod 137 by means of a support which, in one embodiment (FIG. 5), comprises an angle bracket 141 and a shock-absorbing suspension system, generally indicated at 145,which allows the hopper 9 to move up and down independent of the bracket 141 through a limited range of movement to provide some shock absorption in the event there is an impact involving the hopper 9 and/or transfer tube 67.

Figure 6:
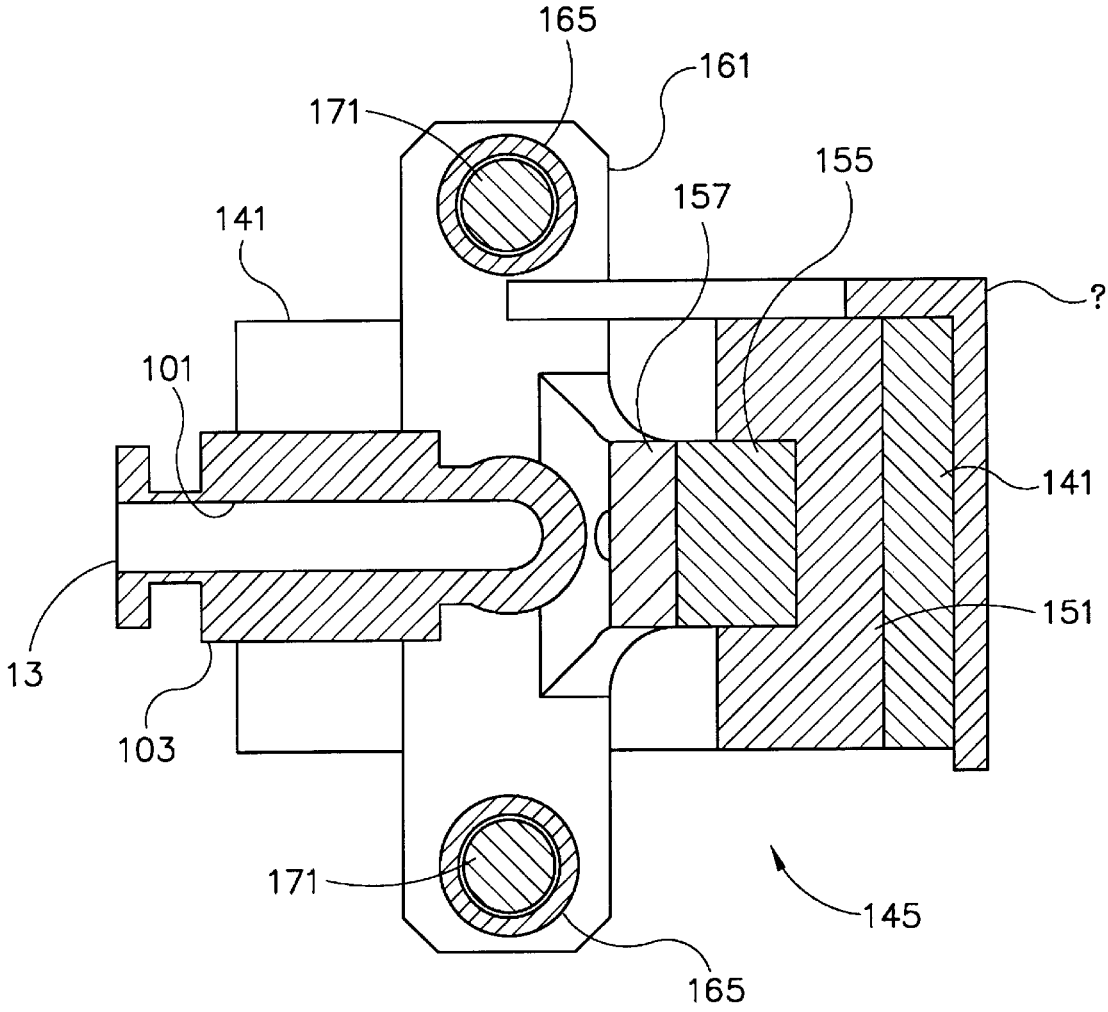
FIG. 6 is a horizontal section on line 6—6 of FIG. 5.

In one embodiment (FIGS. 3, 5 and 6), the suspension system 145 comprises a track 151 affixed to the bracket 141, a linear slider 155 slidable up and down in the track 151, and a frame 157 on the hopper attached to the slider. The frame 157 is secured to the cover 95 of the hopper and has an upper cross bar 161 spaced above the cover. A pair of standoffs 165 extend between the cover 95 and opposite ends of the cross bar 161 to reinforce and stabilize the assembly. The standoffs 165 are fastened to the cross bar 161 and to the cover 95 by suitable fasteners 171. The arrangement is such that in the event an upward force is applied to the hopper 9 and/or transfer tube 67, the hopper will move upward a limited distance to dissipate any shock to the system. Upon removal of the upward force, the hopper returns to the lower limit of its travel under the influence of gravity. Suitable shock absorbing elements (not shown) may be provided at the upper and lower limits of movement. The hopper may be mounted on the robot 21 in other ways. Alternatively, the hopper may be mounted in fixed position, and the source wells 3 and destination wells 5 may move relative to the hopper, as by mean of one or more conveyors (e.g., turntables) or the like.

In the preferred embodiment, a vibrator device 181 vibrates the hopper 9 to inhibit bridging of the powder in the hopper, especially at the transfer port 11, and to otherwise promote the free flow of the powder from the hopper over a wide range of particle sizes. In the embodiment shown in FIG. 5, the vibrator device 181 is mounted on the cover 95 of the hopper and is of conventional design, comprising a vibrator motor and an eccentric mass (not shown) rotated by the motor to produce the desired vibrations. By way of example, the motor can be 1.3 DC vibrating motor having a rated RPM of 7500 at 1.3VDC, such as is commercially available from Jameco, Part No. 190078. The vibrations generated by the vibrator are at a suitable frequency and amplitude depending on various factors, including the type of powder being handled. For example, for #80 mesh size SiC powder, the vibrator 181 may be operated to produce a gentle sinusoidal vibration. On the other hand, for particles which tend to agglomerate, a larger amplitude of vibration may be necessary to promote the free flow of particles. The frequency of vibration will also vary, with one preferred range being 20 Hz–1000 Hz, and another being 30 Hz–400 Hz. The term "vibration" is used in a broad sense to mean the application of alternating or oscillating forces (e.g., tapping or shaking forces) to the hopper tending to disturb the particles in the hopper to promote free flow.

The robot 21 is programmable in conventional fashion to move the hopper 9 from the one or more sources 3, where an aspiration operation occurs, to the one or more destination receptacles 5, where a dispensing operation occurs, and back again. Other types of conveying devices may be used to transport the hopper. Alternatively, the hopper 9 may remain fixed, and the source and destination vessels 3, 5 may be moved relative to the hopper, as by one or more conveyors, turntables or other mechanisms.

Referring again to FIG. 2, the gas flow control system 17 comprises, in one embodiment, a vacuum pump 201 for generating a flow of air through the suction line 107 attached to the hopper 9 toward the pump. The pump 201 has a vent indicated at 205. The control system also includes a flow controller 209 in the suction line 107 for controlling the rate of flow through the line. In one embodiment, this flow controller comprises a mass flow control device, but it will understood that other flow control devices (e.g., a proportional valve) could be used. A filter 215 and on/off valve 217 are provided in the suction line between the hopper and the flow control.

The flow control system 17 is controlled by the processor 25 to generate an upward flow of air or other gas through the hopper transfer port 11 at different selected velocities greater than 0.0 m/s. These velocities include (1) an aspirating velocity for aspirating powder into the hopper from at least one of the one or more sources to form a fluidized bed 221 of powder in the hopper 9 above the transfer port 11 (see FIG. 3), (2) a transporting velocity sufficient to maintain the powder fluidized and contained in the hopper against the force of gravity during transport of the hopper, and (3) a dispensing velocity less than the aspirating velocity but sufficient to maintain fluidization of the bed while allowing powder from the bed 221 to gravitate through the transfer port 11 for dispensing into at least one of the one or more destination wells 5. The magnitude of these velocities will vary depending on the type of particles being transferred, particle density, hopper geometry, the desired rate of powder aspiration and powder dispensing, and other factors. By way of example, suitable aspiration and transport velocities may be 0.1 m/s to 10.0 m/s (e.g., about 2.8 m/s for #80 mesh size SiC particles), and a suitable dispensing velocity may range from 0.0 m/s to 5.0 m/s. It may be desirable to vary the velocity of gas flow during aspiration and dispensing, as discussed later. In any event, the gas velocity is preferably such that the powder is maintained as a fluidized bed 221 in the hopper and not pulled in bulk up against the filter 111.

Referring again to FIGS. 1 and 2, the system includes a weighing system comprising a first weigher in the form of a scale 231, for example, for weighing the amount of powder aspirated into the hopper 9 from the one or more source wells 3. In one embodiment, the block 31 containing the aforementioned source wells 3 sits on the scale, using any suitable registration mechanism (not shown) for accurately positioning the block (or other holder) on the scale so that the precise position of each source well 3 is known to the automated transport system 21. The scale 231 monitors the decreasing weight of the block 31 as powder is aspirated into the hopper to provide a measurement of the amount of powder so aspirated. The scale 231 can be of any conventional type (e.g., a precision electronic balance capable of communication with the processor 25) having suitable accuracy and capacity (e.g., readable to within 1.0 mg with a capacity of 2 kilograms). Alternatively, the amount of powder aspirated can be measured in other ways, as by monitoring the increasing weight of the hopper 9 as it fills with powder, or by measuring the decreasing height of powder in the source well 3, or by measuring the increasing height of powder in the hopper. Other measuring systems may also be suitable.

The weighing system of this embodiment also includes a second weigher in the form of a scale 235, for example, for weighing the amount of powder dispensed from the hopper 9 into the one or more destination receptacles, e.g., the array of wells 5 in the block 35. In the embodiment of FIG. 1, the block is precisely positioned on the scale by a positioning device, generally designated 241, so that the precise position of each destination well 5 is known to the robot. The scale 235 monitors the increasing weight as powder is dispensed from the hopper 9 to provide a measurement of the amount of powder so dispensed. The scale 235 can be of any conventional type (e.g., a precision electronic balance capable of communication with the processor 25) having suitable accuracy and capacity (e.g., readable to within 0.1 mg with a capacity of 510 grams). In general, the second scale 235 requires greater accuracy than the first scale 231, since small amounts are being dispensed and measured to greater accuracy. The amounts dispensed into the destination wells 5 could be measured in other ways, as by measuring the decreasing height of powder in the hopper 9, or by measuring the increasing height of powder in the wells 5. Other measuring systems may also be suitable.

FIGS. 7A–7D illustrate the device 241 for positioning the block 35 on the second weigher 235 as comprising, in one embodiment, a track 247 secured by means of a bracket 251 to a housing 255 of the second weigher 235, a vertical slider 261 slidable up and down in the track 247, and a fork 265 comprising a base 267 attached to the slider 261 and a pair of tines or arms 269 extending forward from the base 267 through openings 275 in the block 35. The arms 269 are configured (e.g., notched) to define a pocket 281 which is dimensioned to snugly receive the block 35 in a front-to-back direction. Also, the arms 269 of the fork 265 are dimensioned to have a close fit in respective openings 275 in a side-to-side direction. For example, the openings 275 may be in the form of vertical slots in the block 35, and each slot may have a width in side-to-side horizontal direction only slightly greater than the width of an arm 269 of the fork 265. As a result, when the block 35 is properly seated in the pocket 281 defined by the arms 269, the block 35 and wells 5 therein are positioned for being precisely located on the scale 235. The openings 275 in the block 35 also serve to reduce the weight of the block so that it may be more accurately weighed by the scale 235.

Figure 7A:
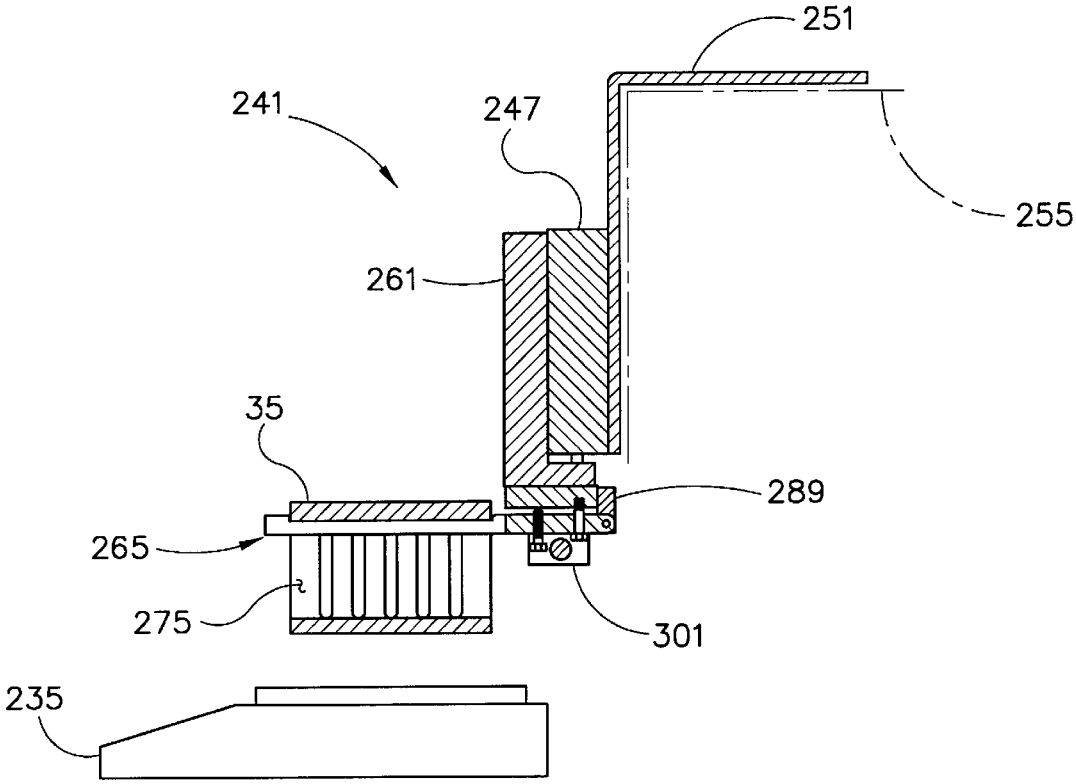
FIGS. 7A–7D are side elevations of a device for precisely positioning an array of destination receptacles on a scale.
Figure 7B:
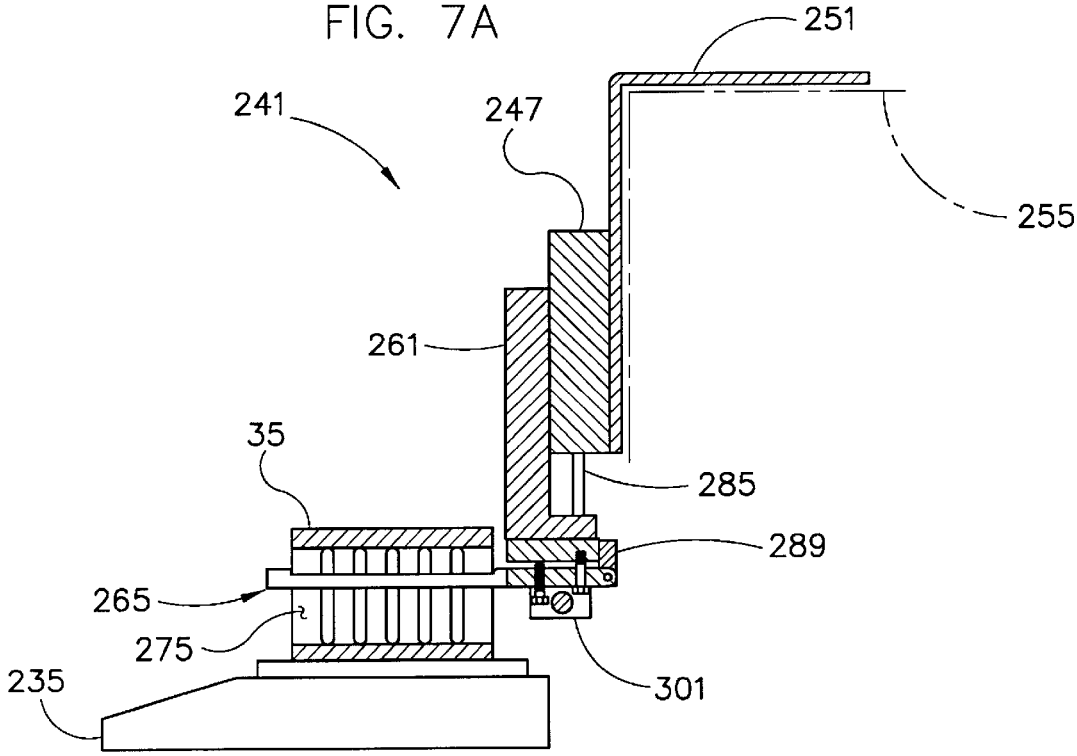
Figure 7C:
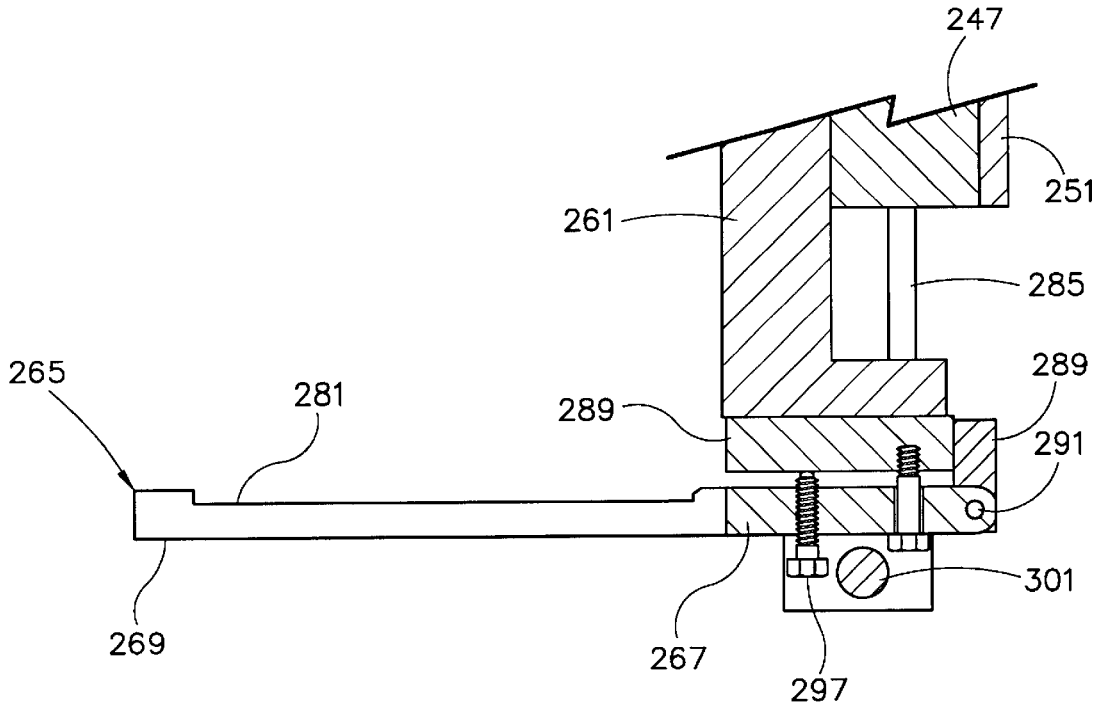
Figure 7D:
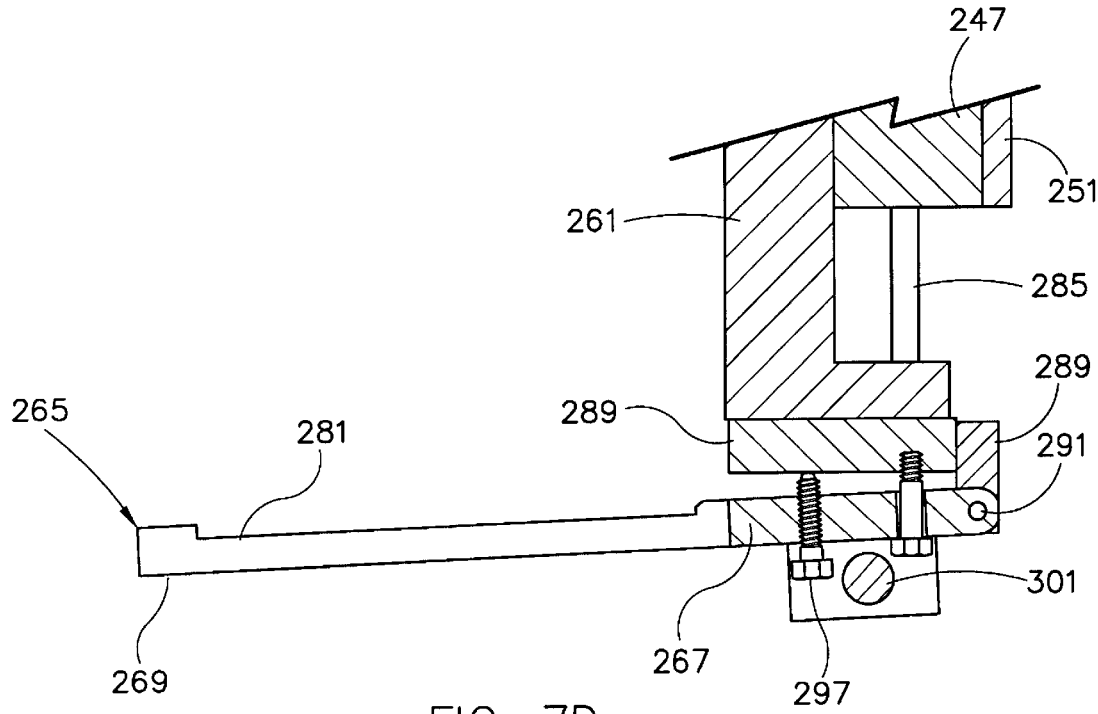

The slider 261 is movable in its track 247 by a suitable power actuator 285 (e.g., a pneumatically extensible and retractable rod) so that the slider and fork 265 can be raised and lowered relative to the scale 235. When the fork 265 is raised and supporting the block 35 (FIG. 7A), the arms 269 of the fork contact the upper ends of respective openings 275 in the block 35 and support the block at a location spaced above the scale. As the slider and fork move down, the block 35 is placed on the scale 235 and the arms move down in the openings 275 to release the block so that its full weight is on the scale (FIG. 7B). The base 267 of the fork is pivoted on a bracket 289 secured to the slider 261 for swinging up and down about a generally horizontal axis 291 (FIGS. 7C and 7D). The angle of the fork 265 relative to ground can be varied by using a pair of adjustment screws 295, 297, one of which (295) extends through a clearance hole in the fork base 267 and threads into the bracket 289, and the other of which (297) threads through the base and pushes against the bracket (FIGS. 7C and 7D). Other positioning devices can be used.

In the preferred embodiment, a packing device (FIGS. 7A and 7B) in the form of a vibrator 301 is mounted on the positioning device 241 and is operable to vibrate the fork 265 and the block 35 on the fork. Such vibration is useful to settle or pack the powder in the wells 5 prior to any dispensing of additional material into the wells, as will be explained.

The processor of FIGS. 1 and 2 is programmed to operate the flow control system 17 to vary the upward flow of air (or other gas) through the transfer port 11 of the hopper 9 as a function of one or more variables. These variables will typically include at least one of the following: (1) information relating to an amount of powder aspirated into the hopper from one or more source wells 3; (2) information relating to a rate at which powder is aspirated into the hopper from the one or more source wells 3; (3) information relating to an amount of powder dispensed from the hopper into one or more destination receptacles 5; and (4) information relating to a rate at which powder is dispensed from the hopper into the one or more destination receptacles 5. In one embodiment, the variable (1) information is provided by the first weigher 231 (or other system used for detecting the amount of powder aspirated); the variable (2) information is derived by the processor 25 based on information received from the first weigher 231 (or other system used for detecting the amount of powder aspirated); the variable (3) information is provided by the second weigher 235 (or other system used for detecting the amount of powder dispensed); and the variable (4) information is derived by the processor 25 based on information received from the second weigher 235 (or other system used for detecting the amount of powder dispensed). In other embodiments, the variable (1)–(4) information can be provided in other ways and by alterative mechanisms. Further, the number of variables may differ from system to system.

Figure 8:
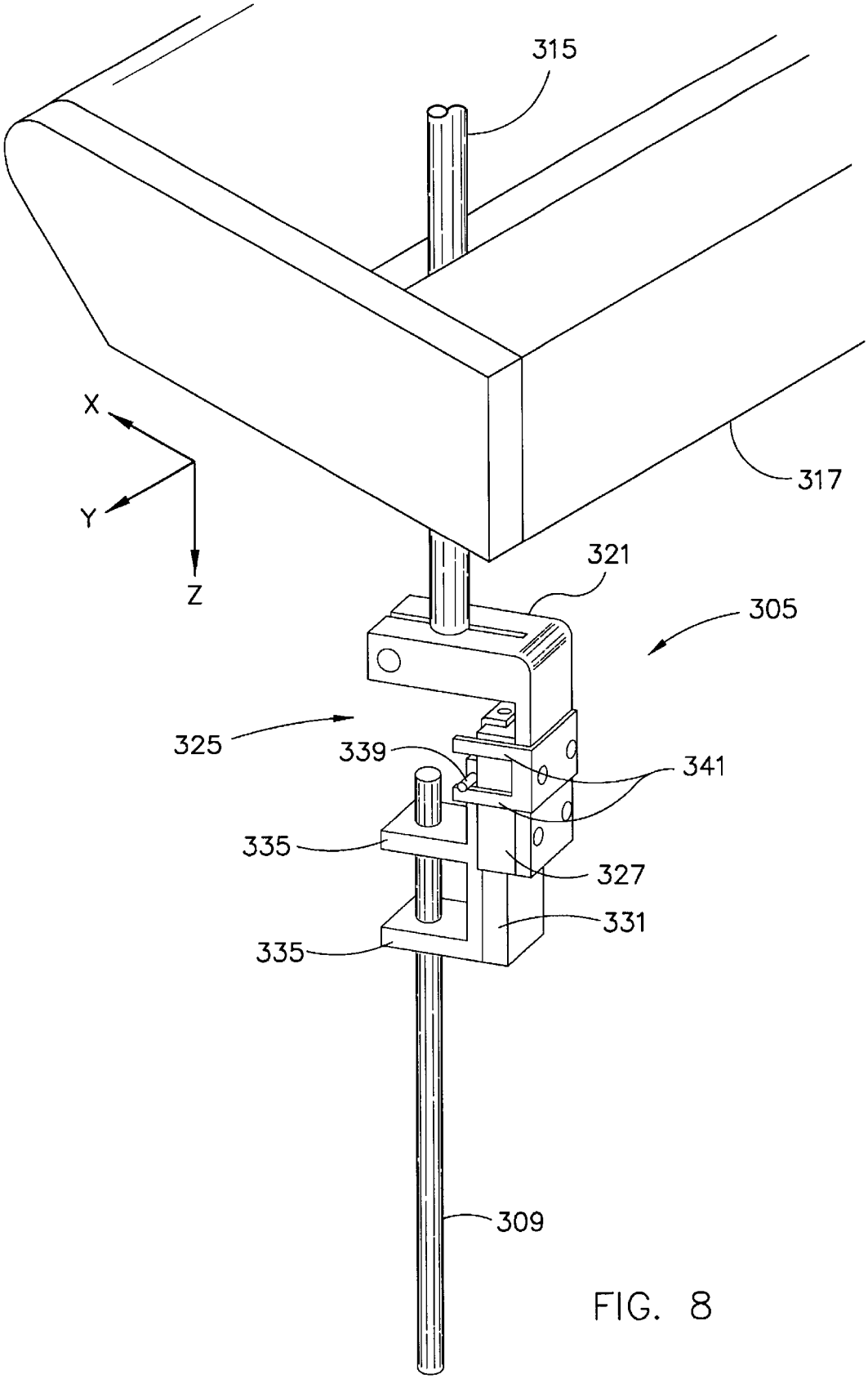
FIG. 8 is a perspective of a device for measuring the height of a powder bed in a destination receptacle.

It may be desirable in certain work flow processes, discussed later, to know the volume of material dispensed into one or more of the destination wells 5. A bed height measuring device, generally designated 305 in FIG. 8, is provided for this purpose. In one embodiment, the measuring device comprises an elongate probe 309 supported by a bracket 321 attached to a vertical Z axis rod 315 mounted on a second arm 317 of the robot 21, so that the probe is movable by the robot along X, Y and Z axes. (In general, the robot 21 functions as a positioning mechanism for effecting relative movement between the probe 309 and the destination receptacles 5.) The probe 309 is supported on the bracket 321 by means of a suspension system 325 which, in one embodiment, is similar to the one for mounting the hopper on the robot. The suspension system 325 comprises a track 327 affixed to the bracket 321, a slider 331 slidable up and down in the track, and a pair of arms 335 extending out from the slider one above the other for holding the probe 309 in position. The probe 309 is preferably slidably adjustable up and down relative to the arms 335 and secured in adjusted position by setscrews or other suitable mechanism (not shown). The vertical range of travel of the slider 331 in the track 327 is limited by a stop arrangement of suitable design, such as a stop element 339 on the slider 331 engageable with upper and lower stops 341 on the bracket 321. The probe 309 remains in its lowered position (set by the contact of the stop element 339 with the lower stop 341) unless an upward force is applied to the probe in which case the probe is free to move upward to a limited extent (set by the contact of the stop element 339 with the upper stop 341), as permitted by the slider 331 sliding up in the track 327. To measure the height of the bed of powder in a particular destination receptacle 5, the robot 21 lowers the probe 309 into a well 5 until the lower end of the probe contacts the bed 345 of powder in the well (see FIG. 12). This contact is sensed by the second weigher 235, and a contact signal is generated to record the vertical position of the Z-axis rod 315 of the robot 21 at the time of such contact. From this information the vertical position of the lower end of the probe 309 in the vessel 5, and thus the height of the powder bed 345, can readily be determined. The probe 309 has an outside diameter significantly less than the inside diameter of a destination well 5 (e.g., 3 mm v. 4 mm) to avoid any contact with the walls of the well as the probe is lowered into the well, and the lower end of the probe is preferably substantially flat with a surface area sufficient to inhibit downward movement through the powder upon contact. The probe 309 is also preferably relatively lightweight (e.g., 5–20 gm) but sufficiently heavy as to be readily detectable by the second weigher 235. Upon contact, the weight should be sensed essentially immediately and further downward movement of the Z-axis rod 315 stopped. In the event there is some slight further movement downward, the probe 309, supported by the powder, will simply move up relative to the robot, as permitted by the slider 331 sliding up in its track 327, so that the only weight sensed by the weigher 235 is the weight of the probe 309. As a result, the height of the bed 345 can be measured with accuracy.

In the embodiment described above, the probe 309 is moved by the robot 21 relative to stationary destination receptacles 5. However, it will be understood that the receptacles 5 could be moved relative to the probe 309 as by a suitable lifting mechanism. In this case, the vertical position of the receptacles instead of the probe would be recorded at the time of contact between the powder bed and the lower end of the probe. A linear stage or other measuring device could be used to record the vertical position of the receptacles.

Figure 9:
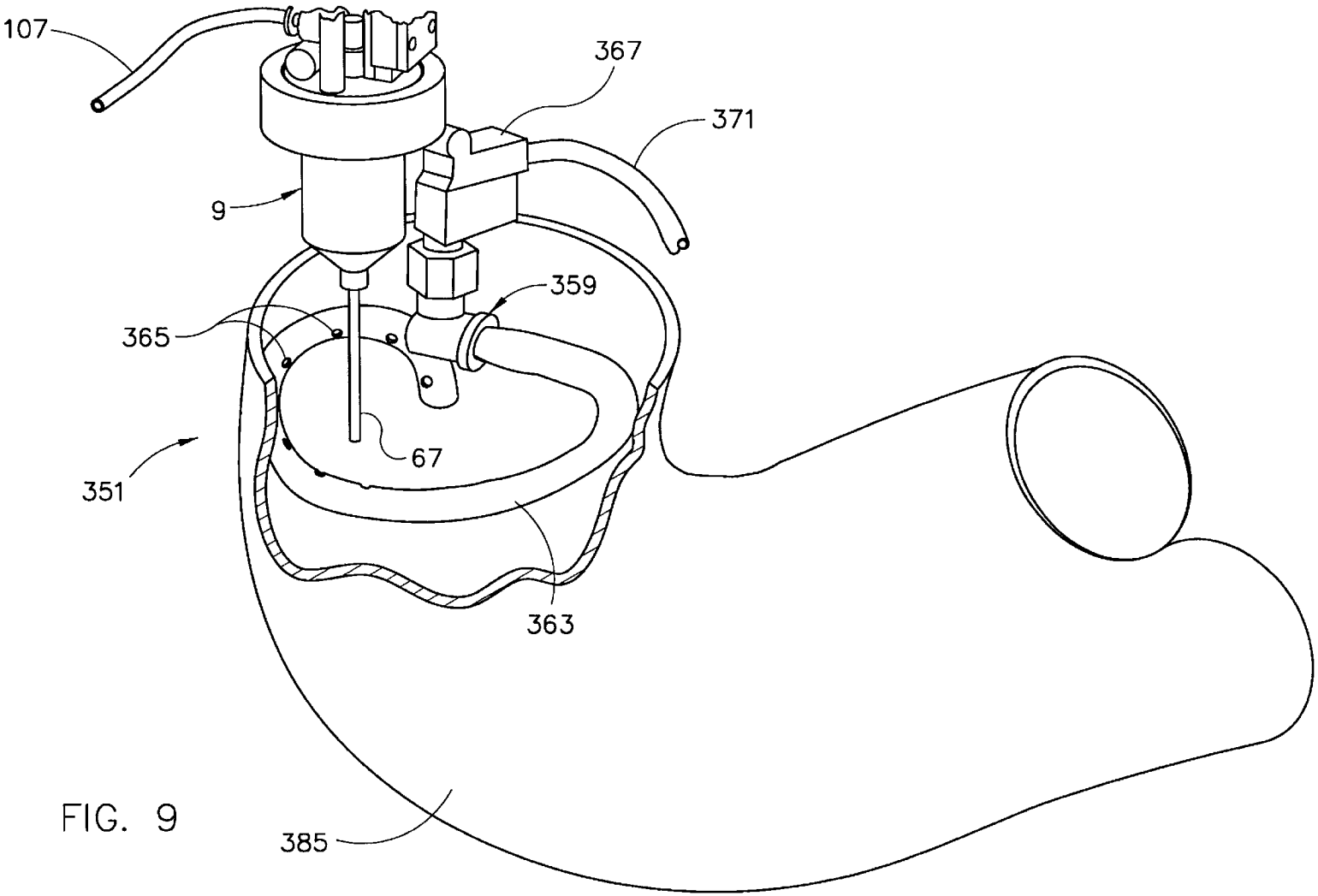
FIG. 9 is a perspective of one embodiment of a cleaning system of the apparatus of FIG. 1.

A cleaning system, generally designated 351, is provided at a cleaning station 355 (FIG. 2) for cleaning the various components of the transfer system. In one embodiment (FIG. 9), the cleaning system 351 comprises a pneumatic blower 359 for blowing powder off the external surfaces of the transfer tube 67, hopper 9 and associated parts. The blower 359 comprises, by way of example, a ring 363 formed from suitable tubing (e.g., 0.2 5 in. tubing), air holes 365 spaced at intervals around the ring for directing jets of gas such as air radially inward (e.g., 0.030 in. air holes spaced at 1.0 cm intervals), and a gas inlet 367 which is connected by an air line 371 to a suitable source of high-pressure gas (e.g., 40–100 psi air). The ring 363 of the blower 359 is sized so that the transfer tube 67 and hopper 9 can be lowered into the ring and subjected to jets of gas to remove powder from exterior surfaces of the hopper and transfer tube. At the same time, the on/off valve 217 in the suction line 107 can be closed and an on/off valve 375 (FIG. 2) in a cleaning line 377 can be opened to introduce a pressurized cleaning fluid 381 into the hopper 9 and down through the transfer tube 67 to clean the internal surfaces of the hopper and tube. The on/off valves 217, 375 are preferably both under the control of the processor 25 to provide a totally automated cleaning process. The cleaning fluid 381 used may be clean dry gas (e.g., air). For pharmaceutical applications or applications where the powder particles are soluble in a liquid, a suitable liquid can be used, such as water or a high volatility solvent (e.g., Methanol, Aceton, or the like), followed by a drying gas flow. If not already activated, the vibrator 181 on the hopper 9 is preferably used during the cleaning operation to loosen any particles stuck on the walls of the hopper and transfer tube.

In one embodiment, the cleaning operation takes place at the cleaning station 355 inside a flexible duct 385 or other enclosed space connected by a vacuum line 391 to a source of vacuum (not shown), so that powder removed from the transfer tube 67 and hopper 9 is disposed to waste. Flow through the vacuum line 391 is controlled by an on/off valve 395 under the control of the processor 25, and the line 391 is provided with a filter 397 and vent 399, as shown in FIG. 2. Other cleaning arrangements may be used.

The components of the system described above are preferably enclosed inside an enclosure 405 (FIG. 1) to avoid undesirable air currents which might adversely affect the accuracy of the weighers 231, 235 and/or disturb the powders used during the transfer process. The enclosure 405 includes a series of transparent panels, at least one of which is movable to form a door 409 providing access to the components inside. In the particular embodiment shown in FIG. 1, the door comprises a front panel movable between a closed position and an open position. The enclosure may have any suitable configuration.

The operation of the system described above can be illustrated by an exemplary process in which the source wells 3 contain catalysis candidates to be screened. To initiate the process, the vibrator 181 on the hopper 9 is activated; the robot 21 is operated to move the hopper 9 into position over a selected source well 3; and the gas flow control system 17 is activated to establish an upward flow of gas through the transfer port 11 at a suitable aspirating velocity. As noted previously, the aspirating velocity may vary, depending on the type, size, density and other characteristics of the powder being aspirated, and on the desired rate of aspiration, the rate of aspiration being directly proportional to the magnitude of the velocity.

With the hopper 9 appropriately positioned over a source well 3, the robot 21 lowers the hopper 9 into the well to aspirate a selected quantity of material into the hopper, as measured by the decrease in weight registered by the weigher 231. During aspiration, powder moves up through the transfer tube 67 and orifice 65 into the hopper, where it is maintained as a fluidized bed 221 above the transfer port 11 by the upwardly moving gas (see FIG. 3). In this fluidized condition, the powder is readily flowable so that powder continues to move freely up into the hopper even as the hopper fills and the overall height of the bed 221 increases. During the aspirating process, the velocity of the gas may be maintained constant, or it may be varied, depending on the desired rate of aspiration. As aspiration continues and the level of powder in the source well 3 goes down, the robot preferably continues to move the transfer tube 67 downward and, optionally, laterally so that the tip of the transfer tube traces a path relative to the powder bed (e.g., a FIG.-8 path). The downward movement of the transfer tube 67 can be intermittent or continuous. The hopper 9 is preferably filled to no more than about 50% of its total volumetric capacity to ensure uniform fluidization of the powder bed 221 in the hopper.

After a desired amount of powder, e.g., 10 mg to 20 g is aspirated into the hopper 9, the robot 21 raises the hopper for transport to the destination receptacle(s) 5. During transport, upward gas flow through the transfer port 11 is continued at a velocity sufficient to maintain the powder in the hopper and in a fluidized condition. The transporting velocity is preferably about the same velocity as the aspirating velocity, but it may be less, so long as it is sufficient to prevent substantial powder from leaking out through the "gate" 81 of the orifice 65 in the transfer port 11. Preferably, the vibrator 181 continues to operate during transport to assist in maintaining the bed of powder in a fluidized state.

Upon arrival at a location above the appropriate destination receptacle (e.g., a particular well 5 in the block 35), the hopper 9 is moved down to lower the transfer tube 67 inside the receptacle and the velocity of the gas through the transfer port 11 is reduced to a level sufficient to permit dispensing of the powder into the receptacle 5. The rate at which the powder is dispensed may be constant or it may be varied by varying the rate (velocity) of gas flow through the transfer port 11. The amount of dispense will vary, but typically will be in the range of 0.1 mg to 500 mg or more.

Figure 10:
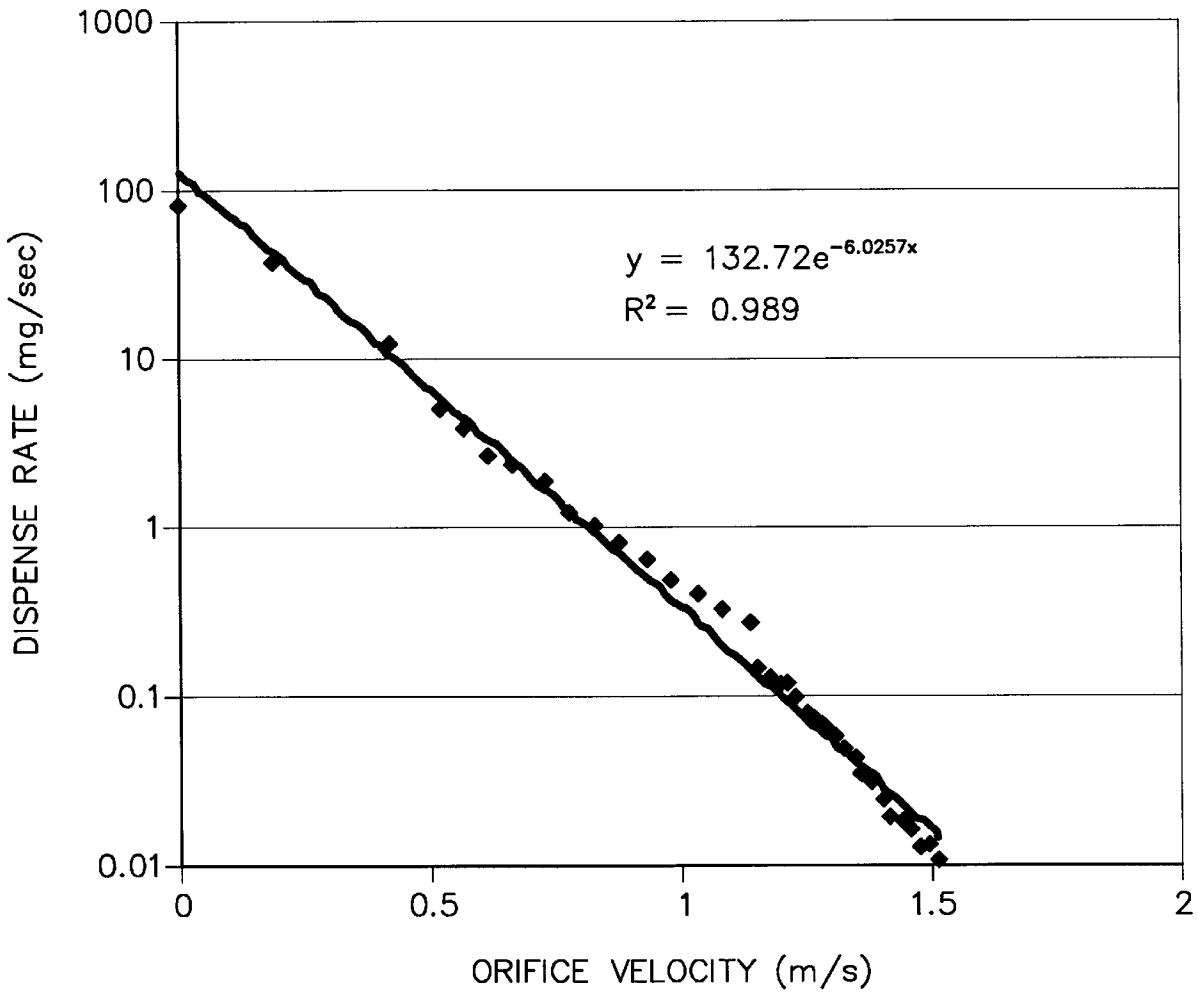
FIG. 10 is a graph showing a relationship between gas velocity through the orifice and the rate at which powder is dispensed through the orifice.

FIG. 10 is a graph showing the relationship between gas (e.g., air) velocity through a transfer port 11 having an orifice gate diameter 79 of 1.5 mm and the rate at which powder is dispensed through the transfer port. As shown, the relationship is an inverse, generally exponential relationship, with the dispensing rate decreasing generally exponentially as the velocity increases from a maximum dispensing rate of about 100 mg/sec at a nominal velocity of 0.0 m/sec. to a negligible dispensing rate of 0.01 mg/sec at a velocity of 1.5 m/s. It has been observed that the relationship between the gas flow rate and the particle dispense rate may be represented by the following equation:

$$R = A(F)^{-b} \qquad \text{(Equation 1)}$$

where R is the particle dispense rate, F is the mass or volumetric flow rate of the working fluid (e.g., gas), and A and b are positive constants which reflect the hydrodynamic properties of the particles being dispensed. These constants can be determined empirically by running an appropriate powder training program. Such a program may involve setting the flow rate through the orifice at a first value and measuring the dispensing rate at that value; setting the orifice gas flow rate at a second value and measuring the dispensing rate at that value; and repeating the process to obtain sufficient data points to generate a graph from which constants A and b can be derived.

Figure 11:
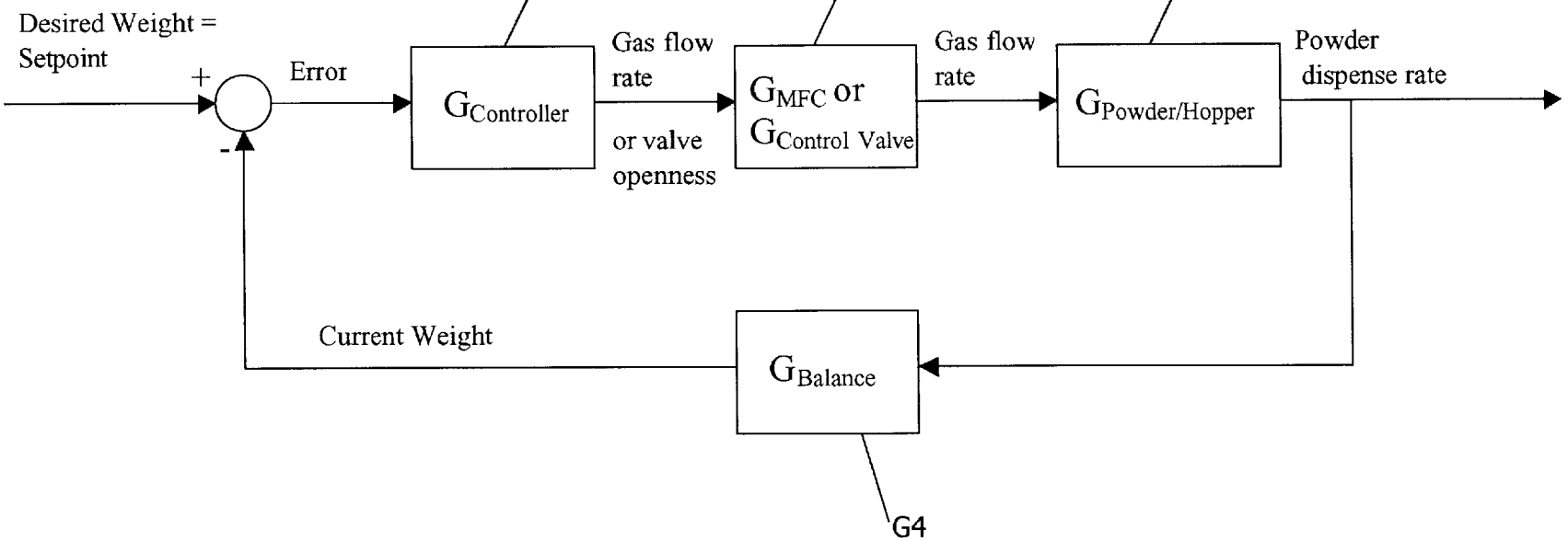
FIG. 11 is a process control diagram illustrating how a dispensing process is controlled.

Equation 1 can be used to develop a dispense algorithm which can then be used by the processor 25 to control the rate at which powder is dispensed, as shown by the process control diagram in FIG. 11 where the various steps in the process are represented by a number of transfer functions G1–G4. For example, assume that the goal of the dispense algorithm is to deliver as quickly as possible the desired quantity of powder to the destination well 5 within a specified error. After A and b are determined, the system can be fully characterized and a conventional PID loop 421 or other linear control algorithm with cut-off can be employed to translate weight readings from the second weigher 235 into dispense rates. Using this algorithm, the processor can be programmed to dispense at a faster rate early in the dispense cycle and at a slower rate diminishing to zero later in the cycle as the target dispense weight is approached to prevent significant overshoot.

In some situations, it may not be possible to accurately determine constants A and b before the dispensing process begins. In such situations, the constants can be developed on the fly during the dispensing process by using an adaptive control algorithm for $G_{controller}$ at G1 in FIG. 11. In this situation, constants A and b are initially assigned certain values, based on historical data for example, and these values are modified during the course of the dispensing process depending on the actual flow rates (velocities) and dispensing rates as measured during the process.

Figure 11A:
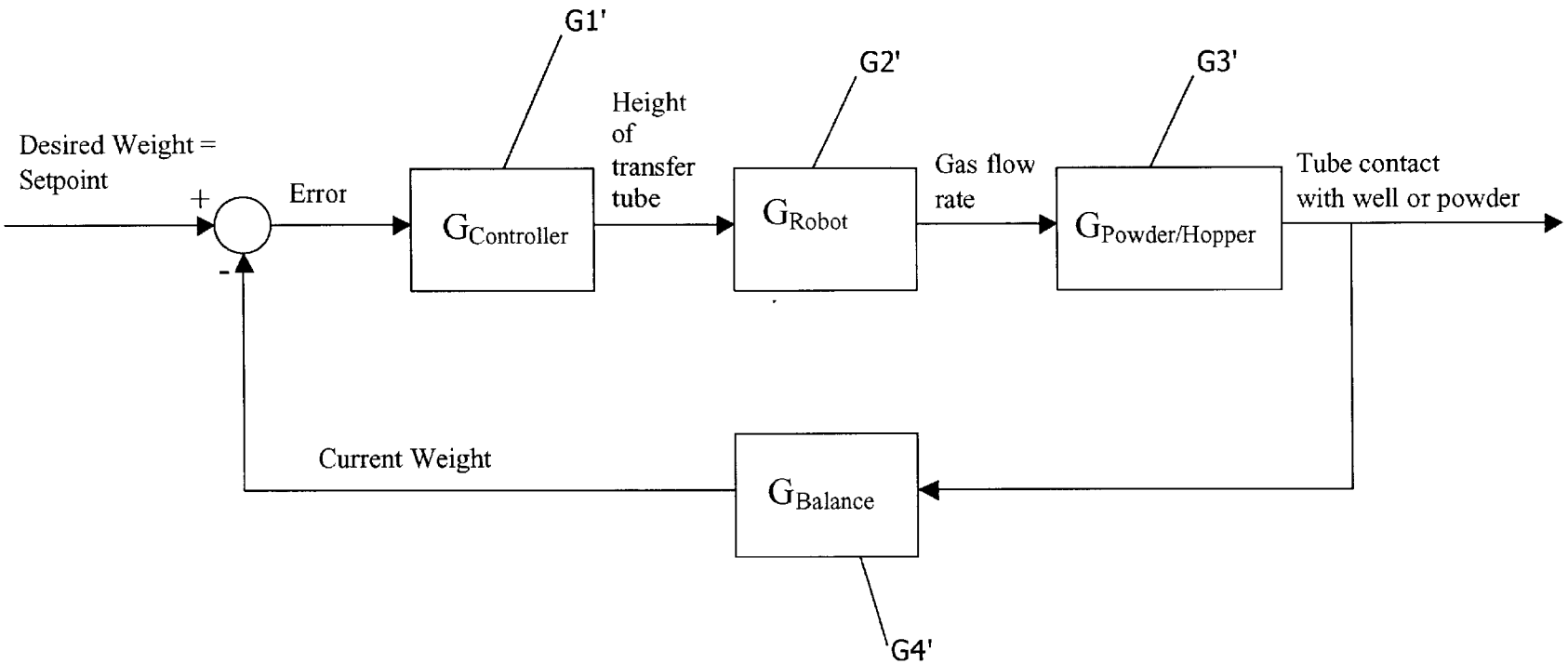
FIG. 11A is a process control diagram illustrating how an aspiration process is controlled.

As shown in FIG. 11A, the same basic process described above is followed for an aspiration operation, except that the process involves different transfer functions G1', G2' and G3'. Further, the weigher involved at function G4' may be either the first weigher 231 or the second weigher 235, since aspiration may occur at either station.

After the desired amount of material has been dispensed into the well 5, as sensed by the second weigher 235, the hopper 9 is moved up and over to the cleaning station 355 for cleaning by the blower 359. The cycle is then repeated until material from each of the desired source wells 3 is transferred to a respective destination well 5, following which the block 35 is lifted from the second weigher 235 and moved to the next stage of the screening process.

Figure 12:
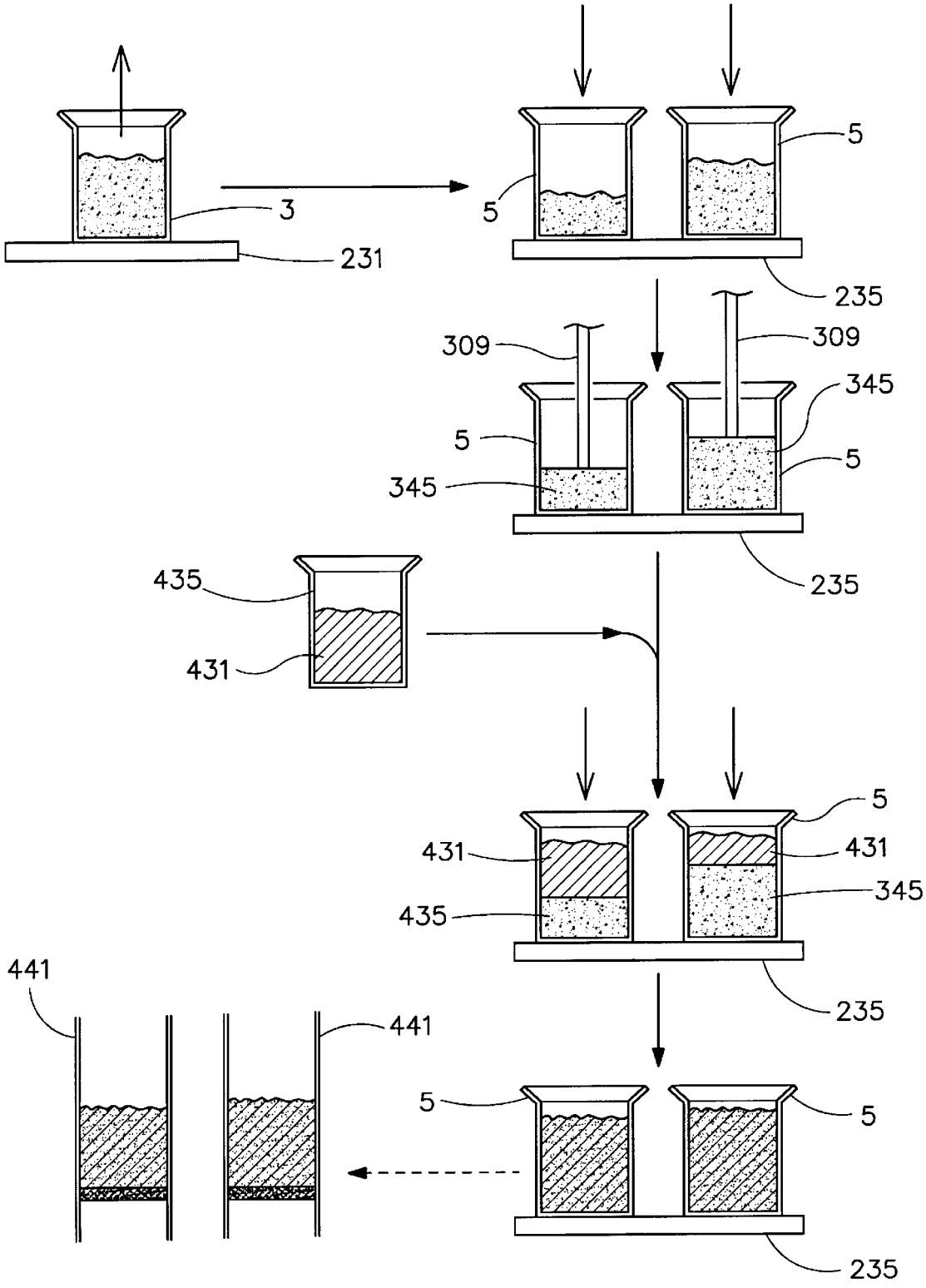
FIG. 12 is a work flow diagram illustrating the steps of a process using the apparatus.

FIG. 12 illustrates a work flow process in which a second powder material (e.g., a diluent) 431 in a vessel 435 is added to the materials in the destination receptacles 5 (only two of which are shown in schematic form) so that the materials in the receptacles 5 occupy the same final volume. In this process, powder (e.g., catalysis material) is aspirated from one or more source receptacles 3 (only one of which is shown in schematic form in FIG. 12) into the hopper 9 and dispensed into respective destination receptacles 5 in the same manner described in the first embodiment. Thereafter, the block 35 is raised by the positioning device 241 and the vibrator device 301 activated to effect settling (packing) of the powders in the receptacles 5. The block 35 is then repositioned on the second scale 235 and the probe 309 of the bed-height measuring device 305 is used to measure the height of each bed 345 in the manner described above. These measurements are used by the processor 25 to calculate, for example, the volume (V1) of powder in each receptacle 5 and the volume (V2) of second powder material (e.g., diluent 431) which needs to be added to each receptacle to bring the total volume of powder in each receptacle to the same stated final volume (V3). The hopper 9 is then used to aspirate this calculated quantity (V2) of second powder material 431 from the second powder source 435 and to dispense the second powder material into each destination receptacle 5 to bring the total volume of material contained in the receptacle to the preset final volume (V3). The bed-height information can also be used to determine other information, such as the density of the powder in each receptacle.

Figure 13:
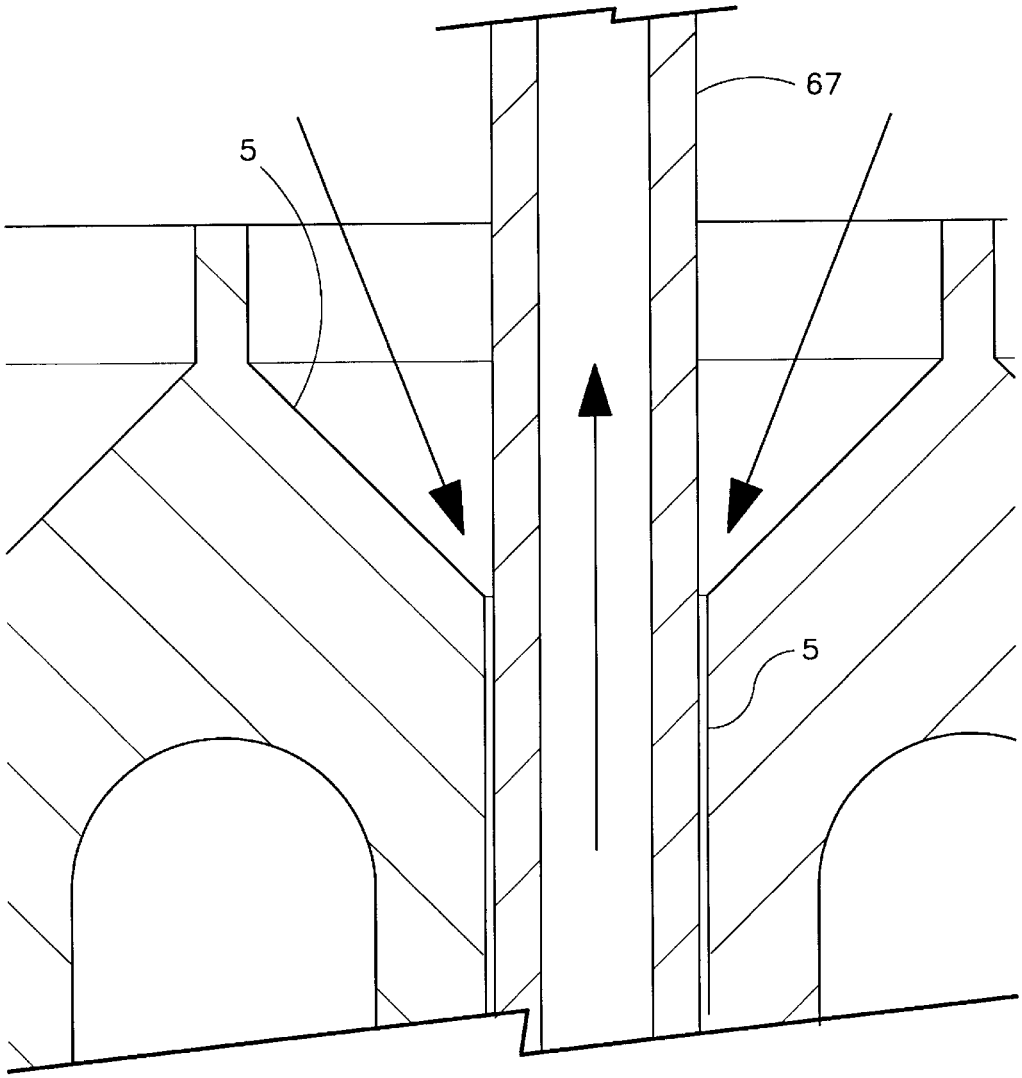
FIG. 13 is an enlarged view showing a portion of the transfer tube of the hopper positioned in a dispensing receptacle for a mixing operation.

In most cases, there will be a need to mix the different materials to provide a heterogeneous mixture for screening. Mixing can be readily effected using the hopper 9 by aspirating the powders from a receptacle 5 into the hopper, maintaining the bed of resultant powder fluidized for a mixing interval or duration sufficient to effect the desired mixing, and then reducing the flow of gas through the transfer port 11 to substantially 0.0 m/s, thereby causing the bed to collapse to maintain the powders in a mixed condition. The mixture is then unloaded back into the same receptacle 5 from which it came, using the vibrator 181 to shake the hopper to facilitate the flow of material through the transfer port 11. To ensure that all powder is aspirated from the receptacle 5 into the hopper 9 for mixing, it is preferably that the outside diameter of the transfer tube 67 be only nominally (slightly) smaller than the inside diameter of the receptacle (FIG. 13).

After the materials from each receptacle 5 are mixed, the hopper 9 is conveyed to the cleaning station 355 where the hopper and transfer tube 67 are cleaned. After all desired mixing has been completed, the block 35 is removed from the fork 265 of the positioning device 241 and conveyed (either manually or by a suitable automated transport mechanism) to a location where the mixtures are to be subjected to a further processing step or steps, such as a parallel fixed bed screening operation using parallel fixed beds 441 (FIG. 12), such as disclosed in U.S. Pat. No. 6,149,882 to Guan et al., U.S. Pat. Appln. Pub. No. 2002-0170976 to Bergh et al., U.S. Pat. Appln. Pub. No. 2002-00048536 to Bergh et al., U.S. Pat. Appln. Pub. No. 2002-0045265 to Bergh et al., and U.S. Pat. Appln. Pub. No. 2002-0042140 to Hagemeyer et al., each of which is hereby incorporated by reference in its entirety for all purposes. Such further processing may involve transferring the mixtures to separate vessels. Alternatively, the mixtures may be retained in the same receptacles 5 (e.g., the wells 5 in the block 35).

While two powders are dispensed into each of the destination receptacles 5 in the above example, it will be understood that more than two powders could be dispensed. Further, the number of powders dispensed into the receptacles can vary from receptacle to receptacle. Also, it is contemplated that the work flow described in FIG. 12, involving the steps of transferring powder (e.g., catalysis material) from one or more source vessels 3, dispensing the powder into an array of destination receptacles 5, weighing the dispensed amounts, packing the powder (optional), measuring the height of the beds 345 in the receptacles 5, adding a second powder (e.g., diluent 431) to the receptacles, and mixing the powders prior to a parallel reaction screening step, could be carried out by an automated solids handling and dispensing system other than a fluidized-bed transfer system of the type described herein.

Figure 14:
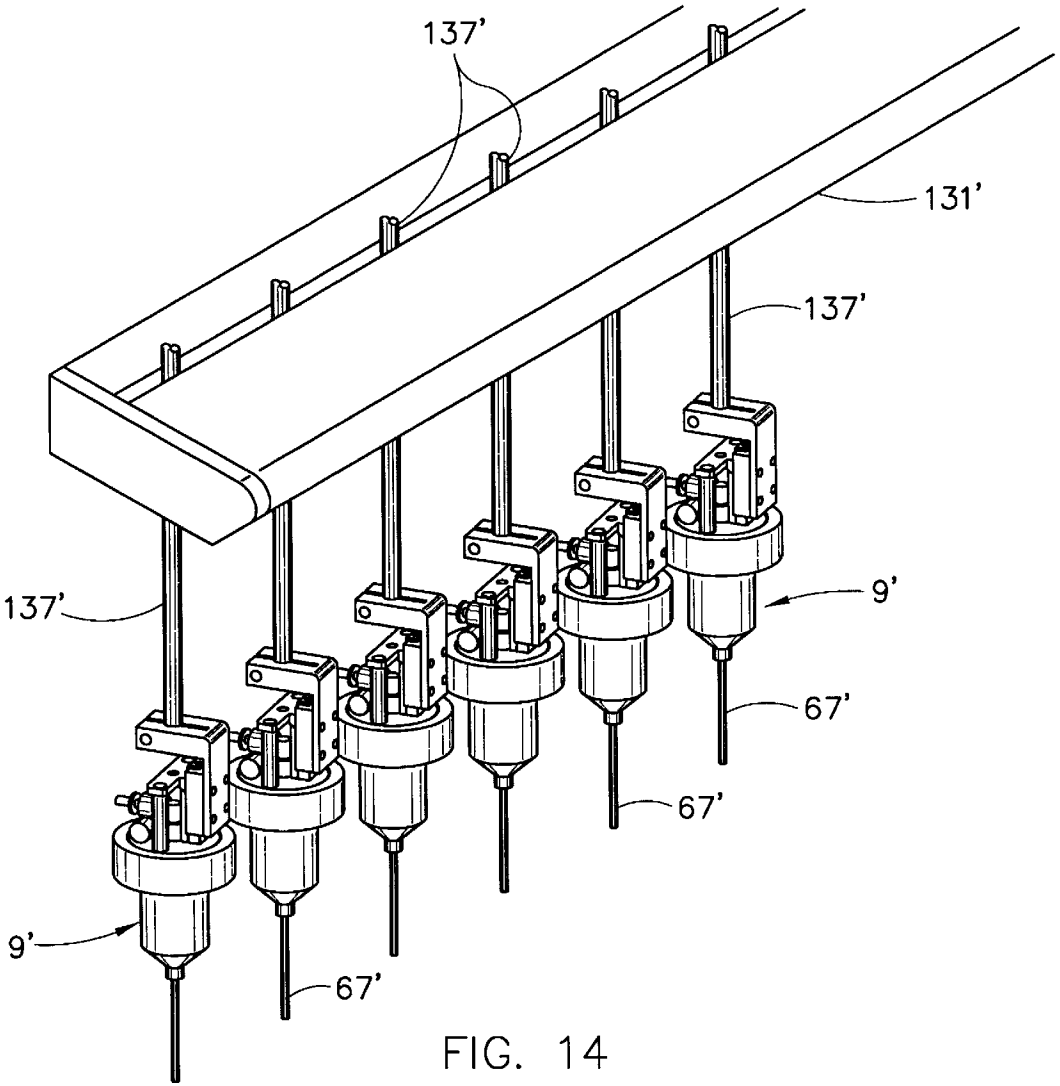
FIG. 14 is a perspective view of an array of hoppers supported by a robot for simultaneously transferring multiple quantities of powder from an array of sources to an array of destination receptacles.

FIG. 14 is a view illustrating another embodiment of the invention capable of simultaneously transferring multiple quantities of the same or different powders from an array of source vessels to an array of destination receptacles. In this embodiment, two or more hoppers, each generally designated 9', are mounted on respective vertical Z-axis rods 137' on an arm 131' of a robot in a linear array formation corresponding to a linear array formation of source vessels and destination receptacles. That is, the centerline spacing of the transfer tubes 67' of the hoppers 9' relative to one another corresponds to the centerline spacing of the source vessels relative to one another and the centerline spacing of the destination receptacles relative to one another. Each hopper 9 of the array is essentially of the same construction and operates in the same way as the hopper 9 of the first embodiment. Preferably, each hopper 9' is operable independent of the other hoppers so that each may aspirate and/or dispense different quantities of powder from respective source vessels and destination receptacles. Further, a separate gas flow control system can be provided for each hopper 9 so that the gas flow velocity may be independently varied for each hopper. The hoppers may be ganged together in other ways and in other arrays. For example, an array of hoppers may be mounted on a common support, e.g., a common mounting plate or bracket, which in turn is attached to a single Z-axis rod of the robot.

It will be observed from the foregoing that the transfer system 1 of this invention represents an improvement over prior art transfer techniques. The system described herein is capable of efficiently transferring small quantities powder from one location to another and dispensing measured quantities of such powders into an array of destination vessels swiftly and accurately. Further, the powder is handled gently and not subjected to harsh crushing forces which might adversely affect one or more physical characteristics (e.g., size) of the particles. The system is also flexible in accommodating a wide variety of source and destination configurations, including one-to-one transfers, one-to-many transfers, and many-to-many transfers. Having both aspirate and dispense functionalities, it can also start over and redispense if it overdispenses on the first try. The system can readily be scaled up or down to different sizes, according to need. Further, the system is capable of handling a wide range of powders having different particle sizes and flow characteristics. The system is particularly suited for applications where accuracy and repeatability are important, as in the pharmaceutical, parallel synthesis and materials research industries.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above constructions and methods without departing from the scope of the invention, it is intended that all matter contained in the above description and shown in the accompanying drawing shall be interpreted as illustrative and not in a limiting sense.

What is claimed is:

1. Apparatus for aspirating and dispensing powder, comprising a hopper having one or more powder transfer ports and one or more suction ports adapted for connection to one or more sources of suction to establish an upward flow of air or other gas through the one or more transfer ports, and a gas flow control system for varying said upward flow through the one or more transfer ports to have different velocities greater than 0.0 m/s, including an aspirating velocity for aspirating powder into the hopper through at least one of said one or more transfer ports to form a fluidized bed of powder in the hopper above said at least one transfer port, and a dispensing velocity less than said aspirating velocity but sufficient to maintain fluidization of the bed while allowing powder from the bed to gravitate through at least one of said one or more transfer ports for dispensing into one or more destination receptacles.

2. Apparatus as set forth in claim 1 further comprising a transport system for transporting the hopper between one or more sources of powder and said one or more destination receptacles.

3. Apparatus as set forth in claim 1 wherein said transport system comprises a robot operable to translate the hopper along at least one horizontal axis and a vertical axis.

4. Apparatus as set forth in claim 2 wherein said different velocities include a transporting velocity sufficient to maintain the powder fluidized and contained in the hopper against the force of gravity during transport of the hopper.

5. Apparatus as set forth in claim 4 wherein said transporting velocity is about the same as said aspirating velocity.

6. Apparatus as set forth in claim 1 wherein said transfer port comprises a transfer orifice having a diameter in the range of 0.1 mm to 10 mm.

7. Apparatus as set forth in claim 1 wherein said transfer port comprises a transfer orifice having a diameter in the range of 0.5 mm to 6.0 mm.

8. Apparatus as set forth in claim 1 wherein said transfer port comprises a transfer orifice having a diameter in the range of 0.75 mm to 4.0 mm.

9. Apparatus as set forth in claim 1 wherein said transfer port comprises a transfer orifice having a diameter in the range of 1.0 mm to 3.0 mm.

10. Apparatus as set forth in claim 1 wherein said aspirating velocity is in the range of 0.1 m/s to 10.0 m/s.

11. Apparatus as set forth in claim 1 wherein said dispensing velocity is less than about 1.5 m/s.

12. Apparatus as set forth in claim 1 wherein said aspirating velocity is in the range of 0.1 m/s to 10.0 m/s and said dispensing velocity is less than about 1.5 m/s.

13. Apparatus as set forth in claim 1 wherein said gas flow control system is operable to vary the dispensing velocity during said dispensing to vary the rate at which powder is dispensed from the hopper.

14. Apparatus as set forth in claim 1 wherein said gas flow control system is operable to vary said upward flow as a function of at least one of the following variables: (1) information relating to an amount of powder aspirated into the hopper; (2) information relating to a rate at which powder is aspirated into the hopper; (3) information relating to an amount of powder dispensed from the hopper; and (4) information relating to a rate at which powder is dispensed from the hopper.

15. Apparatus as set forth in claim 14 wherein said gas flow control system is operable for varying the amount of air flowing through said hopper.

16. Apparatus as set forth in claim 14 further comprising a system for measuring the amount of powder aspirated into the hopper and providing the information in said variable (1).

17. Apparatus as set forth in claim 16 wherein said measuring system comprises a weighing system.

18. Apparatus as set forth in claim 17 wherein said weighing system is operable to measure the weight of said one or more sources of powder.

19. Apparatus as set forth in claim 14 further comprising a system for measuring the amount of powder dispensed from the hopper into said one or more destination receptacles and providing the information in said variable (3).

20. Apparatus as set forth in claim 19 wherein said system for measuring the amount of powder dispensed comprises a weighing system.

21. Apparatus as set forth in claim 1 further comprising a system for measuring the amount of powder aspirated into the hopper.

22. Apparatus as set forth in claim 21 wherein said measuring system comprises a weighing system.

23. Apparatus as set forth in claim 22 wherein said weighing system is operable to measure the weight of said one or more sources of powder.

24. Apparatus as set forth in claim 1 further comprising a system for measuring the amount of powder dispensed from the hopper into said one or more destination receptacles.

25. Apparatus as set forth in claim 24 wherein said system for measuring the amount of powder dispensed comprises a weighing system.

26. Apparatus as set forth in claim 25 wherein said weighing system is operable to measure the weight of said one or more destination receptacles.

27. Apparatus as set forth in claim 26 wherein said measuring system is further operable to measure the volume of powder transferred to each of said one more destination receptacles.

28. Apparatus as set forth in claim 27 wherein said measuring system comprises a probe, a positioning mechanism for effecting relative movement between the probe and said destination receptacle to cause the probe to be inserted into the receptacle and moved into contact with a bed of powder in the receptacle, said weighing system being operable to sense and signal said contact and said positioning mechanism being operable to sense the relative position of the probe inside the receptacle at the time of said contact whereby the volume of powder in the receptacle can be determined.

29. Apparatus as set forth in claim 28 wherein said positioning mechanism comprises a robot carrying said probe.

30. Apparatus as set forth in claim 28 further comprising a device for packing said powder in said destination vessels.

31. Apparatus as set forth in claim 30 wherein said packing device comprises a vibrator for vibrating said destination vessels.

32. Apparatus as set forth in claim 1 further comprising a measuring system for measuring the volume of powder transferred to each of said one more destination receptacles.

33. Apparatus as set forth in claim 32 further comprising a device for packing said powder in said destination vessels.

34. Apparatus as set forth in claim 33 wherein said packing device comprises a vibrator for vibrating said destination vessels.

35. Apparatus as set forth in claim 32 wherein said measuring system comprises a probe, a positioning mechanism for effecting relative movement between the probe and said destination receptacle to cause the probe to be inserted into the receptacle and moved into contact with a bed of powder in the receptacle, a system for sensing and signaling said contact, said positioning mechanism being operable to record the relative position of the probe inside the receptacle at the time of said contact whereby the volume of powder in the receptacle can be determined.

36. Apparatus as set forth in claim 1 wherein said transfer port comprises an orifice at a lower end of the hopper and a transfer tube extending down from adjacent the orifice.

37. Apparatus as set forth in claim 36 further comprising a support for supporting the hopper, and a suspension system on the support allowing the hopper to move up and down independently of the support.

38. Apparatus as set forth in claim 37 wherein said support is on a robot whereby the hopper can be moved by the robot from one location to another.

39. Apparatus as set forth in claim 1 further comprising a vibrating device on the hopper for vibrating the hopper.

40. Apparatus as set forth in claim 1 wherein the hopper has a total volumetric capacity in the range of 1 ml to 40 l.

41. Apparatus as set forth in claim 1 wherein the hopper has a total volumetric capacity in the range of 10 ml to 2 l.

42. Apparatus as set forth in claim 1 wherein the hopper has a total volumetric capacity in the range of 25 ml to 400 ml.

43. Apparatus as set forth in claim 1 wherein the hopper has a total volumetric capacity in the range of about 50 ml.

44. Apparatus as set forth in claim 1 further comprising a filter in the hopper adjacent the suction port for blocking entry of powder into the suction port.

45. Apparatus as set forth in claim 44 wherein said filter is configured for flattening the flow velocity profile across the hopper.

46. Apparatus as set forth in claim 1 wherein said hopper has a funnel-shaped lower section for funneling powder to said one or more transfer ports.

47. Apparatus as set forth in claim 46 wherein said lower section has an interior surface with slopes down at an angle in the range of 30 to 60.

48. Apparatus as set forth in claim 47 wherein said lower section has an interior surface with slopes down at an angle in the range of about 40 to 60 degrees.

49. Apparatus as set forth in claim 1 comprising an array of hoppers for aspirating powder from an array of sources and dispensing powder into an array of destination receptacles.

50. Apparatus as set forth in claim 49 further comprising a transport system for transporting said array of hoppers between said array of sources of powder and said array of destination receptacles.

51. Apparatus as set forth in claim 50 further comprising a weigher for weighing said array of destination receptacles.

52. A method of transferring powder from one or more sources to one or more destination receptacles, said method comprising the steps of establishing an upward flow of air or other gas through one or more transfer ports of a hopper, maintaining said upward flow at an aspirating velocity sufficient to aspirate powder into the hopper from at least one of said one or more sources through at least one of said one or more transfer ports to form a fluidized bed of powder in the hopper above said at least one transfer port, and reducing the velocity of said upward flow to a dispensing velocity less than said aspirating velocity to dispense powder from the hopper by allowing powder from the fluidized bed to gravitate through at least one of said one or more transfer ports into at least one of said one or more destination receptacles.

53. A method as set forth in claim 52 further comprising transporting the hopper between one or more sources of powder and said one or more destination receptacles.

54. A method as set forth in claim 53 further comprising maintaining said upward air flow during said transporting step at a transporting velocity sufficient to maintain the powder fluidized and contained in the hopper against the force of gravity.

55. A method as set forth in claim 54 wherein said transporting velocity is about the same as said aspirating velocity.

56. A method as set forth in claim 52 further comprising maintaining said bed fluidized between said aspirating and dispensing steps.

57. A method as set forth in claim 52 wherein said transfer port comprises a transfer orifice having a diameter in the range of 0.1 mm to 10.0 mm.

58. A method as set forth in claim 52 wherein said aspirating velocity is in the range of 0.1 m/s to 10.0 m/s.

59. A method as set forth in claim 52 wherein said dispensing velocity is less than about 1.5 m/s.

60. A method as set forth in claim 52 wherein said aspirating velocity is in the range of 0.1 m/s to 10.0 m/s, and said dispensing velocity is less than about 1.5 m/s.

61. A method as set forth in claim 52 further comprising varying said dispensing velocity during said dispensing to vary the rate at which powder is dispensed from the hopper.

62. A method as set forth in claim 52 further comprising controlling said aspirating velocity as a function of an amount of powder aspirated into the hopper from said one or more sources.

63. A method as set forth in claim 62 further comprising a step of measuring an amount of powder aspirated into the hopper.

64. A method as set forth in claim 63 wherein said measuring step comprises weighing said amount of powder aspirated into the hopper.

65. A method as set forth in claim 52 further comprising a step of measuring an amount of powder aspirated into the hopper.

66. A method as set forth in claim 65 wherein said measuring step comprises weighing said amount of powder aspirated into the hopper.

67. A method as set forth in claim 52 further comprising a step of controlling said dispensing velocity as a function of an amount of powder dispensed from the hopper into said one or more destination receptacles.

68. A method as set forth in claim 67 further comprising a step of measuring an amount of powder dispensed from the hopper into said one or more destination receptacles.

69. A method as set forth in claim 68 wherein said measuring step comprises weighing an amount of powder dispensed from the hopper.

70. A method as set forth in claim 69 wherein said measuring step comprises measuring the volume of powder dispensed into said destination receptacle.

71. A method as set forth in claim 70 wherein said volume is measured by effecting relative movement between a probe and said destination receptacle to cause the probe to be inserted into the receptacle and moved into contact with a bed of powder in the receptacle, and sensing said contact to determine the relative position of the probe inside the receptacle at the time of said contact whereby the volume of powder in the receptacle can be determined.

72. A method as set forth in claim 71 wherein said relative movement is effected by moving the probe relative to said destination receptacle.

73. A method as set forth in claim 71 further comprising packing the bed of powder before said contact occurs.

74. A method as set forth in claim 73 wherein said packing step is effected by vibrating said destination receptacle.

75. A method as set forth in claim 71 wherein said powder dispensed into said one or more destination receptacles is a first powder, said method further comprising using said hopper to dispense a second powder different from the first powder into said destination receptacles so that said first and second powders in each destination receptacle occupy the same final volume, and mixing said first and second powders.

76. A method as set forth in claim 75 wherein said mixing step comprises aspirating said powders into the hopper through said one or more transfer ports to form a fluidized bed, maintaining the bed in a fluidized state thereby to mix the powders, and unloading the mixed powders from the hopper through said one or more transfer ports.

77. A method as set forth in claim 76 wherein said unloading step comprises reducing said aspirating velocity to substantially 0.0 m/s to collapse the bed, and shaking the hopper to unload the powder.

78. A method as set forth in claim 77 wherein said shaking is effected by vibrating the hopper.

79. A method as set forth in claim 76 wherein said mixed powders are unloaded back into the same destination receptacle from which they were aspirated.

80. A method as set forth in claim 52 further comprising measuring the volume of powder dispensed into said destination receptacle.

81. A method as set forth in claim 80 wherein said volume is measured by effecting relative movement between a probe and said destination receptacle to cause the probe to be inserted into the receptacle and moved into contact with a bed of powder in the receptacle, and sensing said contact to determine the relative position of the probe inside the receptacle at the time of said contact whereby the volume of powder in the receptacle can be determined.

82. A method as set forth in claim 81 wherein said relative movement is effected by moving the probe relative to said destination receptacle.

83. A method as set forth in claim 81 further comprising packing the bed of powder before said contact occurs.

84. A method as set forth in claim 83 wherein said packing step is effected by vibrating said destination receptacle.

85. A method as set forth in claim 81 wherein said powder dispensed into said one or more destination receptacles is a first powder, said method further comprising using said hopper to dispense a second powder different from the first powder into said destination receptacles so that said first and second powders in each destination receptacle occupy the same final volume, and mixing said first and second powders.

86. A method as set forth in claim 85 wherein said mixing step comprises aspirating said powders into the hopper through said one or more transfer ports to form a fluidized bed, maintaining the bed in a fluidized state thereby to mix the powders, and unloading the mixed powders from the hopper through said one or more transfer ports.

87. A method as set forth in claim 86 wherein said unloading step comprises reducing said aspirating velocity to substantially 0.0 m/s to collapse the bed, and shaking the hopper to unload the powder.

88. A method as set forth,in claim 87 wherein said shaking is effected by vibrating the hopper.

89. A method as set forth in claim 86 wherein said mixed powders are unloaded back into the same destination receptacle from which they were aspirated.

90. A method as set forth in claim 52 wherein said dispensing step comprises dispensing first and second powders into each of said one or more destination receptacles, said method further comprising mixing said first and second powders by aspirating said powders into the hopper through said one or more transfer ports to form a fluidized bed, maintaining the bed in a fluidized state thereby to mix the powders, and unloading the mixed powders from the hopper through said one or more transfer ports.

91. A method as set forth in claim 90 wherein said unloading step comprises reducing said aspirating velocity to substantially 0.0 m/s to collapse the bed, and shaking the hopper to unload the powder.

92. A method as set forth in claim 91 wherein said shaking is effected by vibrating the hopper.

93. A method as set forth in claim 90 wherein said mixed powders are unloaded back into the same destination receptacle from which they were aspirated.

94. A method as set forth in claim 52 further comprising filtering said air or other gas to block entry of powder into the suction port.

95. A method as set forth in claim 52 further comprising vibrating the hopper during at least said dispensing step.

96. A method as set forth in claim 95 further comprising vibrating the hopper during said aspiration step.

97. A method as set forth in claim 52 further comprising aspirating powder from an array of sources into an array of hoppers, and dispensing powder from said array of hoppers into an array of destination receptacles.

98. A method as set forth in claim 97 further comprising transporting said array of hoppers between said array of sources of powder and said array of destination receptacles.

99. A method of transferring powder from one or more sources to one or more destination receptacles, said method comprising the steps of establishing an upward flow of air or other gas through one or more transfer ports of a hopper, and varying said upward flow through the transfer port to have different velocities greater than 0.0 m/s, including an aspirating velocity for aspirating powder into the hopper from at least one of said one or more sources through at least one of said one or more transfer ports to form a fluidized bed of powder in the hopper above said at least one transfer port, and a dispensing velocity less than said aspirating velocity but sufficient to maintain fluidization of the bed while allowing powder from the bed to gravitate through at least one of said one or more transfer ports for dispensing into at least one of said one or more destination receptacles.

* * * * *